US008342932B2

(12) United States Patent
Fleckenstein

(10) Patent No.: US 8,342,932 B2
(45) Date of Patent: Jan. 1, 2013

(54) SYSTEMS, METHODS AND ARTICLES TO FACILITATE PLAYING CARD GAMES WITH INTERMEDIARY PLAYING CARD RECEIVER

(75) Inventor: Allen Fleckenstein, Bellevue, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 284 days.

(21) Appl. No.: 11/478,360

(22) Filed: Jun. 29, 2006

(65) Prior Publication Data

US 2007/0057462 A1 Mar. 15, 2007

Related U.S. Application Data

(60) Provisional application No. 60/716,538, filed on Sep. 12, 2005, provisional application No. 60/802,923, filed on May 23, 2006.

(51) Int. Cl.
*A63F 13/00* (2006.01)
*A63F 9/24* (2006.01)

(52) U.S. Cl. ..... 463/12; 273/148 A; 273/148 R; 273/149 R; 273/149 P; 273/309

(58) Field of Classification Search ..... 463/12; 273/274, 148 R, 148 A, 149 R, 150, 309, 273/149 P See application file for complete search history.

(56) References Cited

U.S. PATENT DOCUMENTS

| | | | | |
|---|---|---|---|---|
| 1,727,800 | A | 9/1929 | Albert | |
| 1,890,504 | A | 12/1932 | Ferguson, Jr. | |
| 2,567,223 | A | 9/1951 | Maher | |
| 2,663,418 | A | 12/1953 | Grunwald | 206/62 |
| 2,694,662 | A | 11/1954 | Hunter, Jr. | 154/121 |
| 2,731,271 | A | 1/1956 | Brown | |
| 3,222,071 | A | 12/1965 | Lang | 273/149 |
| 3,312,473 | A | 4/1967 | Friedman et al. | 273/149 |
| 3,339,223 | A | 9/1967 | Laby | 16/105 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |
| 3,667,759 | A | 6/1972 | Barr | 273/152.1 |

(Continued)

FOREIGN PATENT DOCUMENTS

DE 3807 127 A1 9/1989

(Continued)

OTHER PUBLICATIONS

U.S. Appl. No. 11/558,409, filed Nov. 9, 2006, Soltys.

(Continued)

*Primary Examiner* — Dmitry Suhol
*Assistant Examiner* — Marcus Jones
(74) *Attorney, Agent, or Firm* — Frank Abramonte; Jared Barrett; Marvin Hein

(57) ABSTRACT

An inventory sensor is positioned and configured to identify playing cards stored in compartments of one or more intermediary playing card receivers. The intermediary playing card receivers may be positioned in a card transport path between an input and an output receiver. The inventory sensor allows an inventory of playing cards to be performed, for example, in response to a possibly anomalous condition or in response to a user request. Playing cards may be transferred back to the intermediary playing card receiver from the output receiver before inventorying. A new randomized set of playing cards can be created at the output receiver after inventorying.

8 Claims, 20 Drawing Sheets

U.S. PATENT DOCUMENTS

| | | | | |
|---|---|---|---|---|
| 3,690,670 | A | 9/1972 | Cassady et al. | 273/149 P |
| 3,735,982 | A | 5/1973 | Gerfin | 273/1 E |
| 3,751,041 | A | 8/1973 | Seifert | 273/149 P |
| 3,752,962 | A | 8/1973 | Greskovics | 235/61.11 |
| 3,814,436 | A | 6/1974 | Boren | 273/149 P |
| 3,897,954 | A | 8/1975 | Erickson et al. | 273/149 R |
| 3,907,282 | A | 9/1975 | Hunter | 271/233 |
| 3,929,339 | A | 12/1975 | Mattioli | 273/148 A |
| 3,937,311 | A | 2/1976 | Gehrke | 192/45 |
| 3,937,312 | A | 2/1976 | Gehrke | 192/45 |
| 3,942,616 | A | 3/1976 | Elmore | 192/45 |
| 3,972,573 | A | 8/1976 | Marola | 308/217 |
| 3,990,555 | A | 11/1976 | Carullo | 192/45 |
| 3,993,176 | A | 11/1976 | Marola et al. | 192/45 |
| 3,993,177 | A | 11/1976 | Gehrke | 192/45 |
| 3,994,377 | A | 11/1976 | Elmore | 192/45 |
| 4,031,376 | A | 6/1977 | Corkin, Jr. | 235/156 |
| 4,241,921 | A | 12/1980 | Miller | 273/148 A |
| 4,244,582 | A | 1/1981 | Raees et al. | 273/293 |
| 4,310,160 | A | 1/1982 | Willette et al. | 273/149 R |
| 4,373,726 | A | 2/1983 | Churchill et al. | 273/138 A |
| 4,377,285 | A | 3/1983 | Kadlic | 273/148 A |
| 4,448,419 | A | 5/1984 | Telnaes | 273/143 R |
| 4,457,512 | A | 7/1984 | Stevenson | 273/148 |
| 4,497,488 | A | 2/1985 | Plevyak et al. | 273/149 R |
| 4,512,580 | A | 4/1985 | Matviak | 273/148 A |
| 4,531,187 | A | 7/1985 | Uhland | 364/412 |
| 4,531,909 | A | 7/1985 | Takeshita | 432/37 |
| 4,534,562 | A | 8/1985 | Cuff et al. | 273/149 P |
| 4,586,712 | A | 5/1986 | Lorber et al. | 273/149 R |
| 4,636,846 | A | 1/1987 | Villarreal | 358/100 |
| 4,659,082 | A | 4/1987 | Greenberg | 273/149 R |
| 4,662,637 | A | 5/1987 | Pfeiffer | 273/149 P |
| 4,667,959 | A * | 5/1987 | Pfeiffer et al. | 273/149 R |
| 4,693,480 | A | 9/1987 | Smith | 273/296 |
| 4,725,079 | A | 2/1988 | Koza et al. | 283/73 |
| 4,728,108 | A | 3/1988 | Neuwahl | 273/296 |
| 4,750,743 | A | 6/1988 | Nicoletti | 273/148 A |
| 4,770,421 | A | 9/1988 | Hoffman | 273/149 R |
| 4,807,884 | A | 2/1989 | Breeding | 273/149 R |
| 4,817,528 | A | 4/1989 | Baker | 101/395 |
| 4,822,050 | A | 4/1989 | Normand et al. | 273/149 P |
| 4,832,341 | A | 5/1989 | Muller et al. | 273/139 |
| 4,832,342 | A | 5/1989 | Plevyak et al. | 273/149 R |
| 4,885,700 | A | 12/1989 | Kondziolka et al. | 364/519 |
| 4,951,950 | A | 8/1990 | Normand et al. | 273/149 P |
| 4,952,799 | A | 8/1990 | Loewen | 250/231.16 |
| 4,969,648 | A | 11/1990 | Hollinger et al. | 273/149 R |
| 4,995,615 | A | 2/1991 | Cheng | 273/292 |
| 4,998,737 | A | 3/1991 | Lamle | 273/296 |
| 5,000,453 | A | 3/1991 | Stevens et al. | 273/149 R |
| 5,039,102 | A | 8/1991 | Miller | 273/148 R |
| 5,053,612 | A | 10/1991 | Pielemeier et al. | 235/462 |
| 5,067,713 | A | 11/1991 | Soules et al. | 273/149 P |
| 5,096,197 | A | 3/1992 | Embury | 273/149 R |
| 5,110,134 | A | 5/1992 | Laughlin et al. | 273/293 |
| 5,114,153 | A | 5/1992 | Rosenwinkel et al. | 273/292 |
| 5,121,921 | A | 6/1992 | Friedman et al. | 273/149 P |
| 5,157,602 | A | 10/1992 | Fields et al. | 364/412 |
| 5,186,464 | A | 2/1993 | Lamle | 273/149 R |
| 5,199,710 | A | 4/1993 | Lamle | 273/149 R |
| 5,224,712 | A | 7/1993 | Laughlin et al. | 273/304 |
| 5,240,140 | A | 8/1993 | Huen | 221/13 |
| 5,241,172 | A | 8/1993 | Lugaresi | 250/231.16 |
| 5,259,907 | A | 11/1993 | Soules et al. | 156/277 |
| 5,261,667 | A | 11/1993 | Breeding | 273/149 R |
| 5,275,400 | A | 1/1994 | Weingardt et al. | 273/85 CP |
| 5,275,411 | A | 1/1994 | Breeding | 273/149 R |
| 5,303,921 | A | 4/1994 | Breeding | 273/149 R |
| 5,312,104 | A | 5/1994 | Miller | 273/148 R |
| 5,317,149 | A | 5/1994 | Uebbing et al. | 250/231.14 |
| 5,332,219 | A | 7/1994 | Marnell, II et al. | 273/138 A |
| 5,344,146 | A | 9/1994 | Lee | 273/149 R |
| 5,356,145 | A | 10/1994 | Verschoor | 273/149 R |
| 5,362,053 | A | 11/1994 | Miller | 273/148 R |
| 5,374,061 | A | 12/1994 | Albrecht | 273/149 R |
| 5,382,024 | A | 1/1995 | Blaha | 273/149 R |
| 5,397,133 | A | 3/1995 | Penzias | 273/439 |
| 5,416,308 | A | 5/1995 | Hood et al. | 235/454 |
| 5,417,431 | A | 5/1995 | Gluck | 273/293 |
| 5,431,399 | A | 7/1995 | Kelley | 273/149 P |
| 5,445,377 | A | 8/1995 | Steinbach | 273/149 R |
| 5,487,544 | A | 1/1996 | Clapper, Jr. | 273/138 A |
| 5,511,784 | A | 4/1996 | Furry et al. | 273/143 R |
| 5,518,249 | A | 5/1996 | Sines et al. | 273/304 |
| 5,575,475 | A | 11/1996 | Steinbach | 273/149 R |
| 5,584,483 | A | 12/1996 | Sines et al. | 273/149 R |
| 5,605,334 | A | 2/1997 | McCrea, Jr. | 273/309 |
| 5,605,504 | A | 2/1997 | Huang | 463/22 |
| 5,613,680 | A | 3/1997 | Groves et al. | 273/138.2 |
| 5,632,483 | A | 5/1997 | Garczynski et al. | 273/148 R |
| 5,636,843 | A | 6/1997 | Roberts | 273/292 |
| 5,654,050 | A | 8/1997 | Whalen-Shaw | 428/35.7 |
| 5,655,961 | A | 8/1997 | Acres et al. | 463/27 |
| 5,669,816 | A | 9/1997 | Garczynski et al. | 463/12 |
| 5,676,372 | A | 10/1997 | Sines et al. | 273/149 R |
| 5,681,039 | A | 10/1997 | Miller | 273/148 R |
| 5,683,085 | A | 11/1997 | Johnson et al. | 273/149 R |
| 5,685,543 | A | 11/1997 | Garner | 273/148 A |
| 5,690,324 | A | 11/1997 | Otomo et al. | 270/58.02 |
| 5,692,748 | A | 12/1997 | Frisco et al. | 273/149 R |
| 5,695,189 | A | 12/1997 | Breeding et al. | 273/149 R |
| 5,698,839 | A | 12/1997 | Jagielinski et al. | 235/493 |
| 5,707,287 | A | 1/1998 | McCrea, Jr. | 463/27 |
| 5,711,525 | A | 1/1998 | Breeding | 273/292 |
| 5,718,427 | A | 2/1998 | Cranford et al. | 273/149 R |
| 5,722,893 | A | 3/1998 | Hill et al. | 463/47 |
| 5,735,525 | A | 4/1998 | McCrea, Jr. | 273/309 |
| 5,743,800 | A | 4/1998 | Huard et al. | 463/26 |
| 5,766,074 | A | 6/1998 | Cannon et al. | 463/16 |
| 5,769,458 | A | 6/1998 | Carides et al. | 283/102 |
| 5,770,533 | A | 6/1998 | Franchi | 463/42 |
| 5,772,505 | A | 6/1998 | Garczynski et al. | 463/12 |
| 5,779,545 | A | 7/1998 | Berg et al. | 463/22 |
| 5,779,546 | A | 7/1998 | Meissner et al. | 463/25 |
| 5,788,573 | A | 8/1998 | Baerlocher et al. | 463/16 |
| 5,791,988 | A | 8/1998 | Nomi | 463/11 |
| 5,803,808 | A | 9/1998 | Strisower | 463/11 |
| 5,803,809 | A | 9/1998 | Yoseloff | 463/13 |
| 5,823,534 | A | 10/1998 | Banyai | 273/269 |
| 5,830,064 | A | 11/1998 | Bradish et al. | 463/22 |
| 5,831,669 | A | 11/1998 | Adrain | 348/143 |
| 5,842,921 | A | 12/1998 | Mindes et al. | 463/16 |
| 5,863,249 | A | 1/1999 | Inoue | 463/20 |
| 5,867,586 | A | 2/1999 | Liang | 382/112 |
| 5,871,400 | A | 2/1999 | Yfantis | 463/22 |
| 5,895,048 | A | 4/1999 | Smith, Jr. | 273/293 |
| 5,911,626 | A | 6/1999 | McCrea, Jr. | 463/27 |
| 5,919,091 | A | 7/1999 | Bell et al. | 463/25 |
| 5,934,866 | A | 8/1999 | Redden | 414/798.9 |
| 5,936,527 | A | 8/1999 | Isaacman et al. | 340/572.1 |
| 5,941,769 | A | 8/1999 | Order | 463/12 |
| 5,941,771 | A | 8/1999 | Haste, III | 463/17 |
| 5,944,310 | A | 8/1999 | Johnson et al. | 273/149 R |
| 5,945,654 | A | 8/1999 | Huang | 235/449 |
| 5,949,050 | A | 9/1999 | Fosbenner et al. | 235/449 |
| 5,954,654 | A | 9/1999 | Eaton et al. | 600/462 |
| 5,967,893 | A | 10/1999 | Lawrence et al. | 463/10 |
| 5,967,894 | A | 10/1999 | Kinoshita et al. | 463/13 |
| 5,989,122 | A | 11/1999 | Roblejo | 463/22 |
| 6,010,404 | A | 1/2000 | Walker et al. | 463/21 |
| 6,019,368 | A | 2/2000 | Sines et al. | 273/149 R |
| 6,039,650 | A | 3/2000 | Hill | 463/47 |
| 6,042,150 | A | 3/2000 | Daley | 283/86 |
| 6,062,981 | A | 5/2000 | Luciano, Jr. | 463/26 |
| 6,066,439 | A | 5/2000 | Nohr et al. | 430/347 |
| 6,068,258 | A | 5/2000 | Breeding et al. | 273/149 R |
| 6,068,552 | A | 5/2000 | Walker et al. | 463/21 |
| 6,093,103 | A | 7/2000 | McCrea, Jr. | 463/27 |
| 6,117,009 | A | 9/2000 | Yoseloff | 463/20 |
| 6,117,012 | A | 9/2000 | McCrea, Jr. | 463/27 |
| 6,120,588 | A | 9/2000 | Jacobson | 106/31.16 |
| 6,126,166 | A | 10/2000 | Lorson et al. | 273/148 R |
| 6,139,014 | A | 10/2000 | Breeding et al. | 273/149 R |
| 6,145,838 | A | 11/2000 | White | 273/295 |
| 6,149,154 | A | 11/2000 | Grauzer et al. | 273/149 R |
| 6,152,822 | A | 11/2000 | Herbert | 463/22 |

6,159,096 A 12/2000 Yoseloff ..... 463/20
6,161,476 A 12/2000 Yoneoka ..... 101/118
6,166,763 A 12/2000 Rhodes et al. ..... 348/143
6,186,892 B1 2/2001 Frank et al. ..... 463/19
6,193,607 B1 2/2001 Kay ..... 463/22
6,196,547 B1 3/2001 Pascal et al. ..... 273/292
6,217,447 B1 4/2001 Lofink et al. ..... 463/12
6,220,959 B1 4/2001 Holmes, Jr. et al. ..... 463/13
6,234,898 B1 5/2001 Belamant et al. ..... 463/25
6,250,632 B1 6/2001 Albrecht ..... 273/149 R
6,254,096 B1 7/2001 Grauzer et al. ..... 273/149 R
6,254,484 B1 7/2001 McCrea, Jr. ..... 463/27
6,267,248 B1 7/2001 Johnson et al. ..... 209/547
6,267,671 B1 7/2001 Hogan ..... 463/25
6,276,267 B1 8/2001 Yoneoka ..... 101/114
6,293,546 B1 9/2001 Hessing et al. ..... 273/138.2
6,293,864 B1 9/2001 Romero ..... 463/12
6,299,167 B1 10/2001 Sines et al. ..... 273/149 R
6,299,170 B1 10/2001 Yoseloff ..... 273/292
6,299,536 B1 10/2001 Hill ..... 463/47
6,312,334 B1 11/2001 Yoseloff ..... 463/25
6,313,871 B1 11/2001 Schubert ..... 348/143
6,315,664 B1 11/2001 Baerlocher et al. ..... 463/21
6,325,373 B1 12/2001 Breeding et al. ..... 273/149 R
6,346,044 B1 2/2002 McCrea, Jr. ..... 463/27
6,357,746 B1 3/2002 Sadowski ..... 273/148 R
6,361,044 B1 3/2002 Block et al. ..... 273/149 R
6,371,482 B1 4/2002 Hall, Jr. ..... 273/138.1
6,386,973 B1 5/2002 Yoseloff ..... 463/13
6,394,902 B1 5/2002 Glavich ..... 463/20
6,402,142 B1 6/2002 Warren et al. ..... 273/149 R
6,403,908 B2 6/2002 Stardust et al. ..... 209/587
6,406,023 B1 6/2002 Rowe ..... 273/292
6,406,369 B1 6/2002 Baerlocher et al. ..... 463/20
6,409,595 B1 6/2002 Uihlein et al. ..... 463/29
6,413,162 B1 7/2002 Baerlocher et al. ..... 463/20
6,425,824 B1 7/2002 Baerlocher et al. ..... 463/16
6,439,425 B1 8/2002 Masek ..... 221/241
6,446,864 B1 9/2002 Kim et al. ..... 235/382
6,457,715 B1 10/2002 Friedman ..... 273/274
6,460,848 B1 * 10/2002 Soltys et al. ..... 273/149 R
6,464,581 B1 10/2002 Yoseloff ..... 463/20
6,468,156 B1 10/2002 Hughs-Baird et al. ..... 463/25
6,471,208 B2 10/2002 Yoseloff et al. ..... 273/143 R
6,485,366 B1 11/2002 Rowe ..... 463/13
6,502,116 B1 12/2002 Kelly et al. ..... 708/250
6,508,709 B1 1/2003 Karmarkar ..... 463/42
6,514,140 B1 2/2003 Storch ..... 463/25
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,856 B1 2/2003 Walker et al. ..... 463/21
6,520,857 B2 2/2003 Soltys et al. ..... 463/29
6,527,271 B2 3/2003 Soltys et al. ..... 273/148 R
6,530,836 B2 3/2003 Soltys et al. ..... 463/29
6,530,837 B2 3/2003 Soltys et al. ..... 463/29
6,533,276 B2 3/2003 Soltys et al. ..... 273/148 R
6,533,662 B2 3/2003 Soltys et al. ..... 463/25
6,533,664 B1 3/2003 Crumby ..... 463/42
6,543,770 B1 4/2003 Kaji et al. ..... 273/148 R
6,561,897 B1 5/2003 Bourbour et al. ..... 463/13
6,568,678 B2 5/2003 Breeding et al. ..... 273/149 R
6,579,179 B2 6/2003 Poole et al. ..... 463/25
6,579,180 B2 6/2003 Soltys et al. ..... 463/25
6,579,181 B2 6/2003 Soltys et al. ..... 463/25
6,581,747 B1 6/2003 Charlier et al. ..... 194/214
6,582,301 B2 6/2003 Hill ..... 463/11
6,588,750 B1 7/2003 Grauzer et al. ..... 273/149 R
6,588,751 B1 7/2003 Grauzer et al. ..... 273/149 R
6,595,857 B2 7/2003 Soltys et al. ..... 463/29
6,599,185 B1 7/2003 Kaminkow et al. ..... 463/16
6,629,889 B2 10/2003 Mothwurf ..... 463/25
6,638,161 B2 10/2003 Soltys et al. ..... 463/12
6,651,981 B2 11/2003 Grauzer et al. ..... 273/149 R
6,651,982 B2 11/2003 Grauzer et al. ..... 273/149 R
6,652,379 B2 11/2003 Soltys et al. ..... 463/22
6,655,684 B2 12/2003 Grauzer et al. ..... 273/149 R
6,656,048 B2 12/2003 Olsen ..... 463/25
6,659,460 B2 12/2003 Blaha et al. ..... 273/149 R
6,663,490 B2 12/2003 Soltys et al. ..... 463/25
6,676,127 B2 1/2004 Johnson et al. ..... 273/149 R
6,676,516 B2 1/2004 Baerlocher et al. ..... 463/25
6,676,522 B2 1/2004 Rowe et al. ..... 463/42
6,685,189 B2 2/2004 Cherven ..... 273/304
6,685,568 B2 2/2004 Soltys et al. ..... 463/47
6,688,979 B2 2/2004 Soltys et al. ..... 463/25
6,698,756 B1 3/2004 Baker et al. ..... 273/149 R
6,698,759 B2 3/2004 Webb et al. ..... 273/292
6,712,693 B1 3/2004 Hettinger ..... 463/20
6,712,696 B2 3/2004 Soltys et al. ..... 463/25
6,719,288 B2 4/2004 Hessing et al. ..... 273/149 R
6,726,099 B2 4/2004 Becker et al. ..... 235/380
6,726,205 B1 4/2004 Purton ..... 273/148 R
6,728,740 B2 4/2004 Kelly et al. ..... 708/250
6,729,956 B2 5/2004 Wolf et al. ..... 463/25
6,729,961 B1 5/2004 Millerschone ..... 463/30
6,752,312 B1 6/2004 Chamberlain et al. ..... 235/375
6,758,751 B2 7/2004 Soltys et al. ..... 463/29
6,857,961 B2 2/2005 Soltys et al. ..... 463/47
6,889,979 B2 5/2005 Blaha et al. ..... 273/149 R
6,896,618 B2 5/2005 Benoy et al. ..... 463/25
6,912,812 B2 7/2005 Inage ..... 49/409
6,923,719 B2 8/2005 Wolf ..... 463/16
6,955,599 B2 10/2005 Bourbour et al. ..... 463/13
6,964,612 B2 11/2005 Soltys et al. ..... 463/47
6,991,540 B2 1/2006 Marlow ..... 463/16
6,991,544 B2 1/2006 Soltys et al. ..... 463/42
7,005,985 B1 2/2006 Steeves ..... 340/572.1
7,011,309 B2 3/2006 Soltys et al. ..... 273/149 R
7,029,009 B2 4/2006 Grauzer et al. ..... 273/149 P
7,036,818 B2 5/2006 Grauzer et al. ..... 273/149 R
7,055,823 B2 6/2006 Denkewicz, Jr. ..... 273/304
7,073,791 B2 7/2006 Grauzer et al. ..... 273/149 R
7,077,332 B2 7/2006 Verschuur et al. ..... 235/492
7,099,035 B2 8/2006 Brooks et al. ..... 358/1.15
7,137,627 B2 11/2006 Grauzer et al. ..... 273/149 R
7,201,656 B2 4/2007 Darder ..... 463/16
7,234,698 B2 6/2007 Grauzer et al. ..... 273/149 R
7,255,344 B2 8/2007 Grauzer et al. ..... 273/149 R
7,271,727 B2 9/2007 Steeves ..... 340/572.7
7,291,068 B2 11/2007 Bryant et al. ..... 463/25
7,311,598 B2 12/2007 Kaminkow et al. ..... 463/16
7,322,576 B2 1/2008 Grauzer et al. ..... 273/149 R
7,338,044 B2 3/2008 Grauzer et al. ..... 273/149 R
7,341,254 B2 3/2008 Loewenstein et al. ..... 273/292
7,364,510 B2 4/2008 Walker et al. ..... 463/42
7,384,044 B2 6/2008 Grauzer et al. ..... 273/149 R
7,404,763 B2 7/2008 Malone et al. ..... 463/13
7,427,233 B2 9/2008 Walker et al. ..... 463/16
7,427,236 B2 9/2008 Kaminkow et al. ..... 463/26
7,448,626 B2 11/2008 Fleckenstein ..... 273/149 R
7,500,915 B2 3/2009 Wolf et al. ..... 463/27
7,510,186 B2 3/2009 Fleckenstein ..... 273/149 R
7,525,283 B2 4/2009 Cheng et al. ..... 320/108
7,578,739 B2 8/2009 Gauselmann ..... 463/27
7,585,217 B2 9/2009 Lutnick et al. ..... 463/16
7,617,151 B2 11/2009 Rowe ..... 705/39
7,684,874 B2 3/2010 Schlottmann et al. ..... 700/9
7,685,516 B2 3/2010 Fischer ..... 715/255
7,686,681 B2 3/2010 Soltys et al. ..... 463/11
7,736,223 B2 6/2010 Pace ..... 463/19
7,744,462 B2 6/2010 Grav et al. ..... 463/27
7,753,781 B2 7/2010 Storch ..... 463/25
7,753,790 B2 7/2010 Nguyen et al. ..... 463/42
7,780,525 B2 8/2010 Walker et al. ..... 463/29
7,824,267 B2 11/2010 Cannon et al. ..... 463/42
7,828,649 B2 11/2010 Cuddy et al. ..... 463/26
7,846,020 B2 12/2010 Walker et al. ..... 463/29
7,850,528 B2 12/2010 Wells ..... 463/42
7,857,702 B2 12/2010 Hilbert ..... 463/47
7,918,738 B2 4/2011 Paulsen ..... 463/43
8,062,121 B2 11/2011 Crivelli ..... 463/25
1,034,402 A1 7/2012 Hardy
2002/0017481 A1 * 2/2002 Johnson et al. ..... 209/547
2002/0024179 A1 2/2002 Chida ..... 273/307
2002/0063389 A1 5/2002 Breeding et al. ..... 273/292
2002/0142846 A1 10/2002 Paulsen ..... 463/43
2002/0147042 A1 10/2002 Vuong et al. ..... 463/40

| | | | | |
|---|---|---|---|---|
| 2002/0163125 | A1 | 11/2002 | Grauzer et al. | 273/149 R |
| 2002/0187821 | A1 | 12/2002 | Soltys et al. | 463/11 |
| 2003/0028480 | A1 | 2/2003 | Rowe | 705/39 |
| 2003/0032474 | A1 | 2/2003 | Kaminkow | 463/25 |
| 2003/0036425 | A1 | 2/2003 | Kaminkow et al. | 463/25 |
| 2003/0064774 | A1 | 4/2003 | Fujimoto et al. | 463/16 |
| 2003/0078789 | A1 | 4/2003 | Oren | 705/1 |
| 2003/0083126 | A1 | 5/2003 | Paulsen | 463/25 |
| 2003/0090064 | A1 | 5/2003 | Hoyt et al. | 273/292 |
| 2003/0176209 | A1 | 9/2003 | Soltys et al. | 463/13 |
| 2003/0232651 | A1 | 12/2003 | Huard et al. | 463/42 |
| 2004/0033095 | A1 | 2/2004 | Saffari et al. | 400/120.01 |
| 2004/0043815 | A1 | 3/2004 | Kaminkow | 463/25 |
| 2004/0067789 | A1 | 4/2004 | Grauzer et al. | 463/11 |
| 2004/0100026 | A1 | 5/2004 | Haggard | 273/304 |
| 2004/0108255 | A1 | 6/2004 | Johnson | 209/547 |
| 2004/0108654 | A1 | 6/2004 | Grauzer et al. | 273/148 R |
| 2004/0132529 | A1 | 7/2004 | Mkrtchyan et al. | 463/29 |
| 2004/0150702 | A1 | 8/2004 | Tsuyoshi et al. | 347/100 |
| 2004/0166918 | A1 | 8/2004 | Walker et al. | 463/16 |
| 2004/0169332 | A1 | 9/2004 | Grauzer et al. | 273/149 R |
| 2004/0207156 | A1 | 10/2004 | Soltys et al. | 273/292 |
| 2004/0224777 | A1 | 11/2004 | Smith et al. | 463/47 |
| 2005/0012270 | A1 | 1/2005 | Schubert et al. | 273/149 R |
| 2005/0023752 | A1 | 2/2005 | Grauzer et al. | 273/149 R |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0040594 | A1 | 2/2005 | Krenn | 273/149 R |
| 2005/0043094 | A1 | 2/2005 | Nguyen et al. | 463/42 |
| 2005/0051955 | A1 | 3/2005 | Schubert et al. | 273/149 R |
| 2005/0051965 | A1 | 3/2005 | Gururajan | 273/292 |
| 2005/0054408 | A1* | 3/2005 | Steil et al. | 463/11 |
| 2005/0055113 | A1 | 3/2005 | Gauselmann | 700/91 |
| 2005/0059479 | A1 | 3/2005 | Soltys et al. | 463/29 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0101367 | A1 | 5/2005 | Soltys et al. | 463/12 |
| 2005/0110210 | A1* | 5/2005 | Soltys et al. | 273/149 P |
| 2005/0121852 | A1 | 6/2005 | Soltys et al. | 273/149 P |
| 2005/0137005 | A1* | 6/2005 | Soltys et al. | 463/13 |
| 2005/0143166 | A1 | 6/2005 | Walker et al. | 463/25 |
| 2005/0164761 | A1 | 7/2005 | Tain | 463/13 |
| 2005/0181856 | A1 | 8/2005 | Cannon et al. | 463/16 |
| 2005/0215311 | A1 | 9/2005 | Hornik et al. | 463/20 |
| 2005/0221882 | A1 | 10/2005 | Nguyen et al. | 463/16 |
| 2005/0239542 | A1 | 10/2005 | Olsen | 463/27 |
| 2005/0282614 | A1 | 12/2005 | Gauselmann | 463/20 |
| 2005/0282626 | A1 | 12/2005 | Manfredi et al. | 463/25 |
| 2005/0288083 | A1 | 12/2005 | Downs et al. | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |
| 2006/0046849 | A1 | 3/2006 | Kovacs | 463/39 |
| 2006/0181026 | A1 | 8/2006 | Wong | 273/292 |
| 2006/0205508 | A1 | 9/2006 | Green | 463/40 |
| 2006/0247013 | A1 | 11/2006 | Walker et al. | 463/20 |
| 2006/0287077 | A1 | 12/2006 | Grav et al. | 463/27 |
| 2007/0015583 | A1 | 1/2007 | Tran | 463/40 |
| 2007/0057462 | A1 | 3/2007 | Fleckenstein | 273/274 |
| 2007/0057469 | A1 | 3/2007 | Grauzer et al. | 273/309 |
| 2007/0060307 | A1* | 3/2007 | Mathis et al. | 463/25 |
| 2007/0060365 | A1 | 3/2007 | Tien et al. | 463/42 |
| 2007/0077990 | A1 | 4/2007 | Cuddy et al. | 463/25 |
| 2007/0093298 | A1 | 4/2007 | Brunet | 463/42 |
| 2007/0111775 | A1 | 5/2007 | Yoseloff | 463/16 |
| 2007/0168251 | A1 | 7/2007 | Hilbert et al. | 705/14 |
| 2007/0235521 | A1 | 10/2007 | Mateen et al. | 235/379 |
| 2007/0259711 | A1 | 11/2007 | Thomas | 463/22 |
| 2007/0287534 | A1 | 12/2007 | Fleckenstein | 463/29 |
| 2008/0026832 | A1 | 1/2008 | Stevens et al. | 463/26 |
| 2008/0026848 | A1 | 1/2008 | Byng | 463/42 |
| 2008/0038035 | A1 | 2/2008 | Shuldman et al. | 400/76 |
| 2008/0045341 | A1 | 2/2008 | Englman | 463/42 |
| 2008/0090651 | A1 | 4/2008 | Baerlocher | 463/27 |
| 2008/0113704 | A1 | 5/2008 | Jackson | 463/13 |
| 2008/0113773 | A1 | 5/2008 | Johnson et al. | 463/25 |
| 2008/0113781 | A1 | 5/2008 | Soltys et al. | 463/28 |
| 2008/0119284 | A1 | 5/2008 | Luciano, Jr. et al. | 463/42 |
| 2009/0005176 | A1 | 1/2009 | Morrow et al. | 463/43 |
| 2009/0011833 | A1 | 1/2009 | Seelig et al. | 463/42 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0163279 | A1 | 6/2009 | Hermansen et al. | 463/42 |
| 2009/0176556 | A1 | 7/2009 | Gagner et al. | 463/25 |
| 2009/0253483 | A1 | 10/2009 | Pacey et al. | 463/20 |
| 2009/0270170 | A1 | 10/2009 | Patton | 463/36 |
| 2009/0275374 | A1 | 11/2009 | Nelson et al. | 463/16 |
| 2009/0275393 | A1 | 11/2009 | Kisenwether et al. | 463/25 |
| 2009/0275411 | A1 | 11/2009 | Kisenwether et al. | 463/42 |
| 2009/0307069 | A1 | 12/2009 | Meyerhofer | 705/14.12 |
| 2010/0016068 | A1 | 1/2010 | White et al. | 463/25 |
| 2010/0113125 | A1 | 5/2010 | Bernard et al. | 463/20 |
| 2010/0125851 | A1 | 5/2010 | Singh et al. | 718/104 |
| 2011/0009184 | A1 | 1/2011 | Byng | 463/20 |

FOREIGN PATENT DOCUMENTS

| | | | |
|---|---|---|---|
| DE | 3807127 | A1 | 9/1989 |
| DE | 44 39 502 | C1 | 9/1995 |
| DE | 197 48 930 | A1 | 5/1998 |
| EP | 0 327 069 | A2 | 8/1989 |
| EP | 0 790 848 | | 8/1997 |
| EP | 0 700 980 | B1 | 11/1999 |
| EP | 1 291 045 | A2 | 3/2003 |
| FR | 530732 | | 12/1921 |
| FR | 24238 | | 3/1922 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| JP | 8255059 | | 10/1996 |
| KR | 20-0335819 | | 12/2003 |
| WO | 87/00445 | | 1/1987 |
| WO | WO 96/36253 | | 11/1996 |
| WO | WO 99/43403 | | 9/1999 |
| WO | WO 02/05914 | A1 | 1/2002 |
| WO | WO 02/051512 | A2 | 7/2002 |
| WO | 03/006928 | A1 | 1/2003 |
| WO | WO 03/004116 | A1 | 1/2003 |
| WO | 2005035084 | A1 | 4/2005 |
| WO | WO 2006/039308 | A2 | 4/2006 |
| WO | 2006/110348 | | 10/2006 |

OTHER PUBLICATIONS

English Translation of German Patent No. DE 197 48 930, publication date of May 14, 1998, inventor: Markeev.
U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 8, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,253, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.
U.S. Appl. No. 11/480,273, filed Jun. 30, 2006, Soltys.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.

U.S. Appl. No. 60/838,280, filed Aug. 17, 2006, Soltys et al.
Bulaysky, J., "Tracking the Tables," *Casino Journal*, May 2004, pp. 44-47, accessed Dec. 21, 2005, URL = http://www.ascendgaming.com/cj/vendors_manufacturers_table/Trackin916200411141AM.htm, 5 pages.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL = http:/bjinsider.com/newsletter_40_surveillance.shtml, 5 pages.
Scarne, J., *Scarne's Encyclopedia of Games*, Harper & Row, New York, 1973, p. 153.
Scarne, J., *Scarne's New Complete Guide to Gambling*, Simon & Schuster, Inc., New York, 1974, pp. 358-359.
Snyder, A., "The High-Tech Eye," excerpt from *Blackjack Forum*, Spring 1997, accessed Dec. 21, 2005, from Casino Software & Services, LLC, URL = http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL = http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bravo Gaming Systems, "Casino Table Wager Analysis and Player Tracking System—Table Operations/Unique Features," accessed Apr. 11, 2005, URL = http://www.genesisgaming.com, 4 pages.
Casino Software & Services, LLC., accessed Aug. 25, 2006, URL = http:/casinosoftware.com/home.html, 6 pages.
International Guild of Hospitality & Restaurant Managers, "Shuffle Master, Inc. (NasdaqNM:SHFL)," accessed Dec. 30, 2003, URL = http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiffs Declaration of Lawrence Luciano in Opposition to Shuffle Master's Motion for Preliminary Injunction, *Card, LLC* v. *Shuffle Master, Inc*., D. Nev. (No. CV-N-03-0244-ECR-(RAM)), Nov. 24, 2003.
Shuffle Master, Inc., "Shuffle Master Announces New Products; Intelligent Table System to Be Debuted at G2E," Sep. 10, 2003, 2 pages.
Singh et al., U.S. Appl. No. 12/271,337, filed Nov. 14, 2008, 35 pages.
Fleckenstein, "Systems, Methods and Articles to Facilitate Playing Card Games with Multi-Compartment Playing Card Receivers," Preliminary Amendment filed Sep. 19, 2006, for U.S. Appl. No. 11/479,963, 4 pages.
Fleckenstein, "Systems, Methods and Articles to Facilitate Playing Card Games with Multi-Compartment Playing Card Receivers," Office Action mailed Aug. 12, 2008, for U.S. Appl. No. 11/479,963, 12 pages.
Fleckenstein, "Systems, Methods and Articles to Facilitate Playing Card Games with Multi-Compartment Playing Card Receivers," Amendment filed Nov. 12, 2008, for U.S. Appl. No. 11/479,963, 18 pages.
Fleckenstein, "Systems, Methods and Articles to Facilitate Playing Card Games with Multi-Compartment Playing Card Receivers," Final Office Action mailed Apr. 16, 2009, for U.S. Appl. No. 11/479,963, 11 pages.
Fleckenstein, "Systems, Methods and Articles to Facilitate Playing Card Games with Multi-Compartment Playing Card Receivers," Amendment After Final filed Jul. 16, 2009, for U.S. Appl. No. 11/479,963, 15 pages.
Fleckenstein, "Systems, Methods and Articles to Facilitate Playing Card Games with Multi-Compartment Playing Card Receivers," Interview Summary mailed Jul. 22, 2009, for U.S. Appl. No. 11/479,963, 4 pages.
Fleckenstein, "Systems, Methods and Articles to Facilitate Playing Card Games with Multi-Compartment Playing Card Receivers," Office Action mailed Oct. 14, 2009, for U.S. Appl. No. 11/479,963, 10 pages.
Fleckenstein, "Systems, Methods and Articles to Facilitate Playing Card Games with Multi-Compartment Playing Card Receivers," Amendment filed Jan. 14, 2010, for U.S. Appl. No. 11/479,963, 15 pages.
International Search Report, mailed Jan. 8, 2007, for PCT/US2006/035331, 3 pages.
Written Opinion, mailed Jan. 8, 2007, for PCT/US2006/035331, 5 pages.
Humble, L., *The World's Greatest Blackjack Book*, Random House, Inc., New York, 1987, p. 182.
MagTek, "Port Powered Swipe Reader," Technical Reference Manual, Manual Part No. 99875094 Rev 12, Jun. 2003, 20 pages.

* cited by examiner

SYSTEMS, METHODS AND ARTICLES TO FACILITATE PLAYING CARD GAMES WITH INTERMEDIARY PLAYING CARD RECEIVER

CROSS-REFERENCE TO RELATED APPLICATION

This application claims the benefit under 35 U.S.C. §119 (e) of U.S. Provisional Patent Application Ser. Nos. 60/716,538 filed Sep. 12, 2005; and 60/802,923 filed May 23, 2006.

BACKGROUND

1. Field

This description generally relates to the field of table gaming, and more particularly to games played with playing cards.

2. Description of the Related Art

There are numerous games played with playing cards. For example, blackjack, baccarat, various types of poker, LET IT RIDE®, and/or UNO®, to name a few. Games may be played with one or more standard decks of playing cards. A standard deck of playing cards typically comprises fifty-two playing cards, each playing card having a combination of a rank symbol and a suit symbol, selected from thirteen rank symbols (i.e., 2, 3, 4, 5, 6, 7, 8, 9, 10, J, Q, K, and A) and four suit symbols (i.e., ♥, ♣, ♦, and ♠). Some games may include non-standard playing cards, for example playing cards with symbols other than the rank and suit symbols associated with a standard deck, such as those used in the game marketed under the brand UNO® by Mattel.

In some instances playing card games involve wagering, where money and/or prizes may be won. In other instances playing card games are played for fun or recreation without wagering. In either case, it is typically desirable to randomize the set of playing cards before dealing the playing cards to the participants (e.g., players and/or dealer). Randomizing is typically referred to as shuffling, which may be performed manually by riffling or interleaving the corners of two stacks of playing cards by hand, or may be performed automatically by an automatic card shuffling machine.

While there may exist variation from casino-to-casino, playing card games typically have a fixed set of theoretical or "true" odds associated with them. The theoretical or true odds are reflected in the schedule of payout or "house" odds associated with the game, and typically provide for a house edge or advantage (e.g., theoretical hold). Many casinos set a house advantage or theoretical hold of at least 0.5%, which means that the house would likely earn 0.5% of every dollar wagered for the particular game over the long term. The house advantage may be as high as 30%, for example for the game Let-It-Ride®.

A casino may, for example, provide a schedule of payout or house odds for blackjack. A typical house odds schedule may provide for a 1:1 or "even money" payout for all winning bets with the exception of blackjack (i.e., initial two cards dealt to player have a total value of twenty-one). A blackjack may be paid at 3:1, unless the dealer also has a blackjack which is typically considered a tie (i.e., push) and no money is exchanged. The theoretical or true odds reflect the statistical probabilities of the occurrence of certain events over a large number of attempts or trials.

The casino typically has a house advantage due to a difference between the theoretical or true odds and the payout or house odds. The casino may achieve a higher house advantage due to specific rules of the game. For example, under most blackjack rules the dealer selects hit cards only after all of the players have completed their hands. This provides the opportunity for the players to draw hands with a value exceeding twenty-one (i.e., bust) and lose, without the dealer having to take any hit cards. Thus, the dealer avoids the possibility of busting, and losing to a player that has already gone bust. Consequently, the house enjoys a further advantage over the true odds of the game. The casino may obtain a further house advantage by setting the rules with respect to when the dealer must take additional playing cards (e.g., stand on hand with value of a hard or soft 17 points, hit on 16 points, etc.). The casino may obtain a further house advantage by selecting the total number of decks from which the card game will be dealt. Thus, while the basic rules determine the theoretical or true odds of the game, variations in the rules as well as the house odds may effect the house advantage.

At least in blackjack, the theoretical true odds reflect the probability of certain outcomes over a large number of hands, predicated on "perfect play" by a player. Typically, players cannot play perfectly, and may make decisions (e.g., hit or stand, split, double down) that do not accord with the decision that would provide the highest probability of winning (e.g., "basic" strategy). This provides a further advantage to the casino or house. Some players adopt various playing strategies to obtain or to try to exceed the theoretical odds. Some of these strategies are legal, some illegal, and some while legal, are discouraged by certain gaming establishments. For example, a player may play basic strategy as outlined in numerous references on gaming. Some players may tracking the playing cards that appear on the gaming table using various card counting strategies (e.g., fives count, tens count), also outlined in numerous references on gaming. This may allow the player to adjust the amount of wagers based on whether the cards remaining to be dealt are thought to be favorable or unfavorable. For example, a set or "deck" having a relatively high percentage of playing cards with a value of ten is typically considered favorable to the dealer, while a relatively low percentage of playing cards with values of 2-8 is typically considered favorable to the player.

Casinos and other gaming establishments are continually looking for ways to make gaming fresher and more exciting for their patrons. For example, many casinos offer the ability to place bonus wagers and/or progressive wagers. New approaches to varying existing card games are highly desirable.

BRIEF SUMMARY

In one embodiment, a playing card handling system comprises an intermediary playing card receiver comprising a plurality of playing card receiving compartments sized to at least partially receive playing cards therein; a sensor configured to sense an identifier from each of a number of playing cards while the playing cards are at least partially received in the playing card receiving compartments of the intermediary playing card receiver; and a processor configured to process the sensed identifiers.

In another embodiment, a playing card handling system comprises a playing card input receiver; a playing card output receiver; at least one playing card transport path extending between the playing card input receiver and the playing card output receiver; a first intermediary playing card receiver disposed between the playing card input receiver and the playing card output receiver in the at least one playing card transport path, the first intermediary playing card receiver comprising a plurality of playing card receiving compartments, the plurality of playing card receiving compartments of the first intermediary playing card receiver physically coupled for movement together; a second intermediary playing card receiver disposed between the playing card input receiver and the playing card output receiver in the at least one playing card transport path, the second intermediary playing card receiver comprising a plurality of playing card receiving compartments, the plurality of playing card receiving compartments of the second intermediary playing card receiver physically coupled for movement together; an inventory optical sensor having a field-of-view that encompasses a portion of the second intermediary playing card receiver, and operable to capture identifying information from a number of playing cards at least partially received in the playing card receiving compartments of the second intermediary playing card receiver; and a control subsystem configured to control a transfer of a plurality of playing cards from the input playing card receiver to the first and the second intermediary playing card receivers. For example, the control subsystem may be operable to perform an inventory of the second intermediary playing card receiver by sequentially moving the second intermediary playing card receiver with respect to the input optical sensor and capturing an image of playing cards in respective ones of the playing card receiving compartments at each of at least some of a plurality of respective positions of the second intermediary playing card receiver.

In another embodiment, a method of operating a playing card handling system comprises storing respective playing cards in each of at least some of a plurality of playing card receiving compartments of an intermediary playing card receiver, the intermediary playing card receiver positioned along at least one playing card transport path between an inlet and an outlet of the playing card handling system; moving the intermediary playing card receiver to successively position each of at least some of the playing card receiving compartments with respect to an inventory playing card sensor; and successively detecting an identity of each of the playing cards with the inventory playing card sensor. The playing cards may be stored in the intermediary playing card receiver in a non-randomized order. Successively detecting an identity of each of the playing cards may comprise capturing an image of at least one identifier on each of the playing cards in the playing card receiving compartments, and/or of a marking that is indicative of a relative position of the playing card receiving compartment.

In another embodiment, a method of operating a playing card handling system comprises detecting a possibly anomalous operating condition; in response to the detection of the possibly anomalous operating condition, determining an identity of each playing card in each of the playing card receiving compartments of the intermediary playing card receiver; and transferring playing cards from the intermediary playing card receiver to a playing card output receiver in a random order, after determining the identity of each playing card in each of the playing card receiving compartments of the intermediary playing card receiver. The method may further comprise transferring playing cards from the playing card output receiver to the intermediary playing card receiver before determining the identity of each playing card in each of the playing card receiving compartments of the intermediary playing card receiver. Determining an identity of each playing card may comprise sequentially pivotally stepping the intermediary playing card receiver through 360 degrees, and capturing an image of a contents of the playing card receiving compartments in at least some of the steps.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with servers, networks, displays, media handling and/or printers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the embodiments.

Description of Gaming Environments

Figure 1:
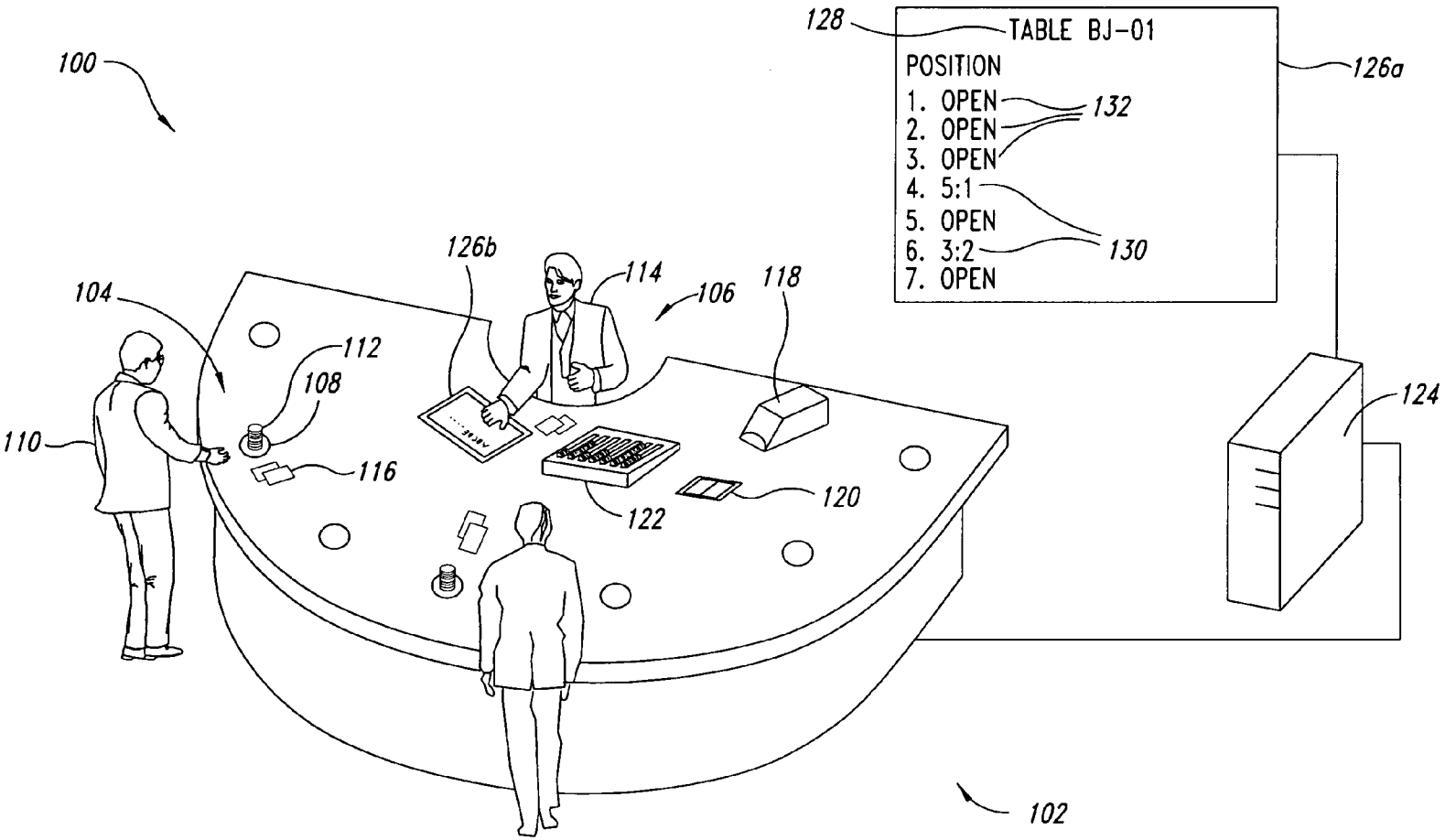
FIG. 1 is a schematic view of a gaming environment, including a gaming table, a host computing system, and at least one display visible to a number of participants, according to one illustrated embodiment.

FIG. 1 shows a gaming environment 100 according one illustrated embodiment.

The gaming environment 100 includes one or more gaming tables 102 having a number of player positions 104 (only one called out in Figure) and a dealer position 106. The player positions 104 are typically associated with a wagering area demarcated on the playing surface of the gaming table 102 and commonly referred to as a betting circle 108 (only one called out in Figure). A player 110 (only one called out in Figure) places a bet or wager by locating one or more chips 112 or other items of value in the betting circle 108.

A dealer 114 deals playing cards 116 to the players 110. In some games, the dealer 114 may deal playing cards to the dealer's own self. The dealer 114 may deal playing cards 116 from a handheld deck or from a card shoe 118. The dealer 114 may retrieve the playing cards 116 from a playing card handling system 120, for example, an automatic shuffling machine. The dealer 114 may load the retrieved playing cards 116 into the card shoe 118, if the card shoe 118 is present on the gaming table 102. The dealer 114 uses a chip tray 122 for storing wagers collected from losing players 110 and for paying out winnings to winning players 110.

The gaming environment 100 may also include a host computing system 124 and one or more displays 126*a*, 126*b* (collectively 126). The host computing system 124 is communicatively coupled to one or more systems and subsystems at the gaming table 102, and to the displays 126*a*, 126*b*. The host computing system 124 may, for example, control or provide information to the display 126*a*, 126*b* for displaying information about the game being played at the gaming table 102. For example, the host computing system 124 can cause the displays 126*a*, 126*b* to display a table identifier 128 that identifies the gaming table 102. The host computing system 124 may also display information about the various player positions 104. For example, the host computing system 124 can cause the display 126*a*, 126*b* to display payout or house odds 130 for each of the player positions 104. Additionally, or alternatively, the host computing system 124 can cause the display 126*a*, 126*b* to display a status indication of the player position 104. For example, the display 126*a*, 126*b* may display information 132 indicating that a player position 104 is open or is not currently open.

One or more of the displays 126*a* may be in the line-of-sight or otherwise visible from one or more of the player positions 104. One or more of the displays 126*b* may be in the line-of-sight or otherwise visible from the dealer position 106. Some embodiments may only include a display 126*b* visible from the dealer position 106, and may or may not include a shield or other features that prevent the players 110 from seeing the information displayed on the display 126*b* visible from the dealer position 106.

One or more displays may provide an input interface for the dealer 114. For example, the display 126*b* may take the form of a touch sensitive display, presenting a graphical user interface (GUI) with one or more user selectable icons. The display 126*b* may be positioned within reach (e.g., within approximately 3 feet) of the dealer position 106. Such may allow the dealer 114 to enter odds information for each of the respective player positions 104. For example, the dealer 114 may enter payout or house odds, such as standard blackjack payout or house odds 3:2 for player position 6, while entering non-standard blackjack payout or house odds (e.g., 5:1) for the fourth player position.

Figure 2:
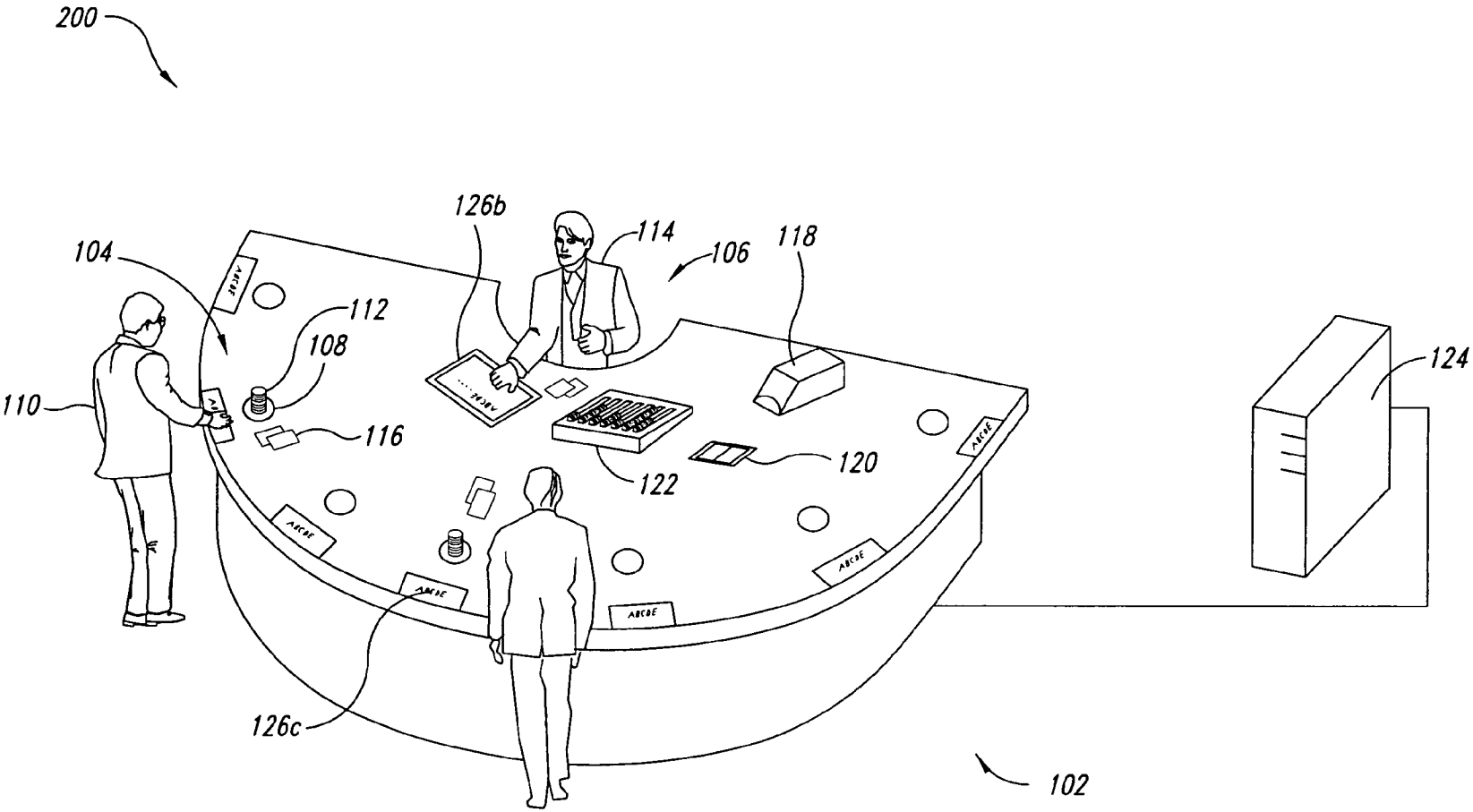
FIG. 2 is a schematic diagram of a gaming environment, including a gaming table, computing system, and a plurality of touch screen displays proximate a number of player positions, according to one illustrated embodiment.

FIG. 2 shows a gaming environment 200 according to another illustrated embodiment. This embodiment and other embodiments described herein are substantially similar to the previously described embodiment, and common acts and structures are identified by the same references. Only significant differences in operation and structure are described below.

In the embodiment illustrated in FIG. 2, displays 126*c* (only one called in the Figure) is positioned proximate respective ones of the player positions 104. The host computing system 124 can cause the displays 126*c* to display information regarding the game. In particular, the host computing system 124 can cause the displays 126*c* to display information regarding payout or house odds for all of the player positions 104. Alternatively, the host computing system 124 can cause the displays 126*c* to display information regarding payout or house odds for only the respective player position 104 to which the display 126*c* is proximate.

The displays 126*c* may take the form of touch screen displays presenting a GUI with user selectable icons. The user selectable icons may allow the players 110 to select payout or house odds for a particular hand or game. The user selectable icons may allow the player 110 to select between a set of predefined house odds (e.g., 1:1, 2:1, 3:1, . . . , 100:1, . . . , 1000:1, etc.) or may permit the user to enter a user defined set of payout or house odds. Alternatively, or additionally, other user input devices may be employed, for example, keypads and/or keyboards. The user selected house odds may be displayed on the display 126*b* viewable by the dealer 114. In other embodiments, the payout or house odds may be kept secret from the dealer 114 as well as from the other players 110.

Figure 3:
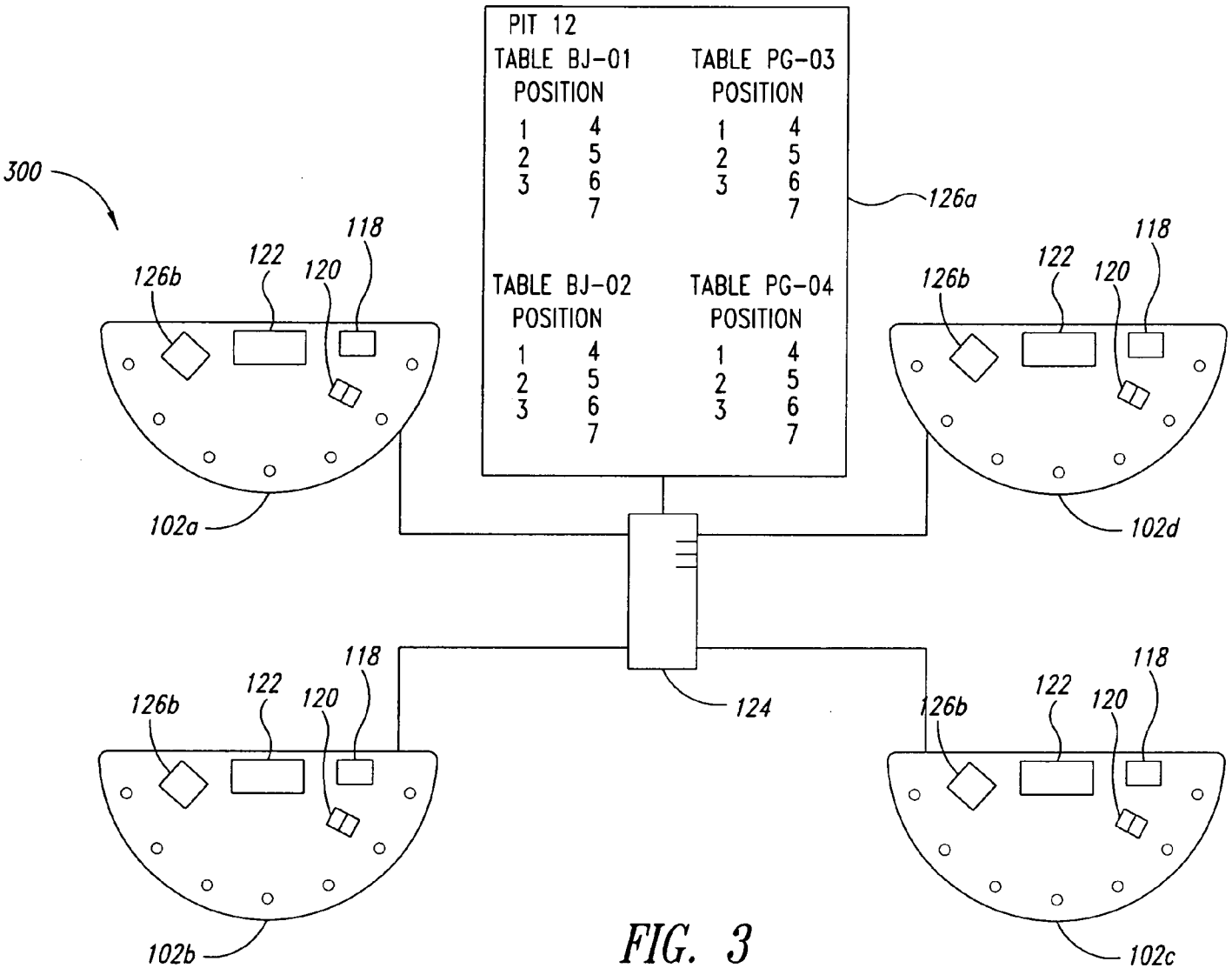
FIG. 3 is a schematic diagram of a gaming environment, including a number of gaming tables associated with the gaming pit, a computing system, and at least one display visible to a number of participants, according to another illustrated embodiment.

FIG. 3 shows a gaming environment 300 in the form of a pit, including a plurality (e.g., four) of gaming tables 102*a*-102*d* communicatively coupled to the display 126*a* via the host computing system 124. The display 126*a* may be viewable by some or all of the players 110 at the various gaming tables 102*a*-102*d*. The displays 126*a* may be viewable by other patrons of the casino. Such may advantageously create excitement amongst the patrons. Such also advantageously allows pit bosses or other casino personnel to easily keep track of the payout or house odds selected by the players 110 in the various player positions 104 at multiple tables. The pit bosses or other casino personnel may quickly and easily discern suspect or extraordinarily high payout or house odds selections. Additionally, or alternatively, the host computing system 124 may provide a notification (e.g., audible and/or visual) to casino security personnel.

Discussion of Suitable Computing Environment

Figure 4:
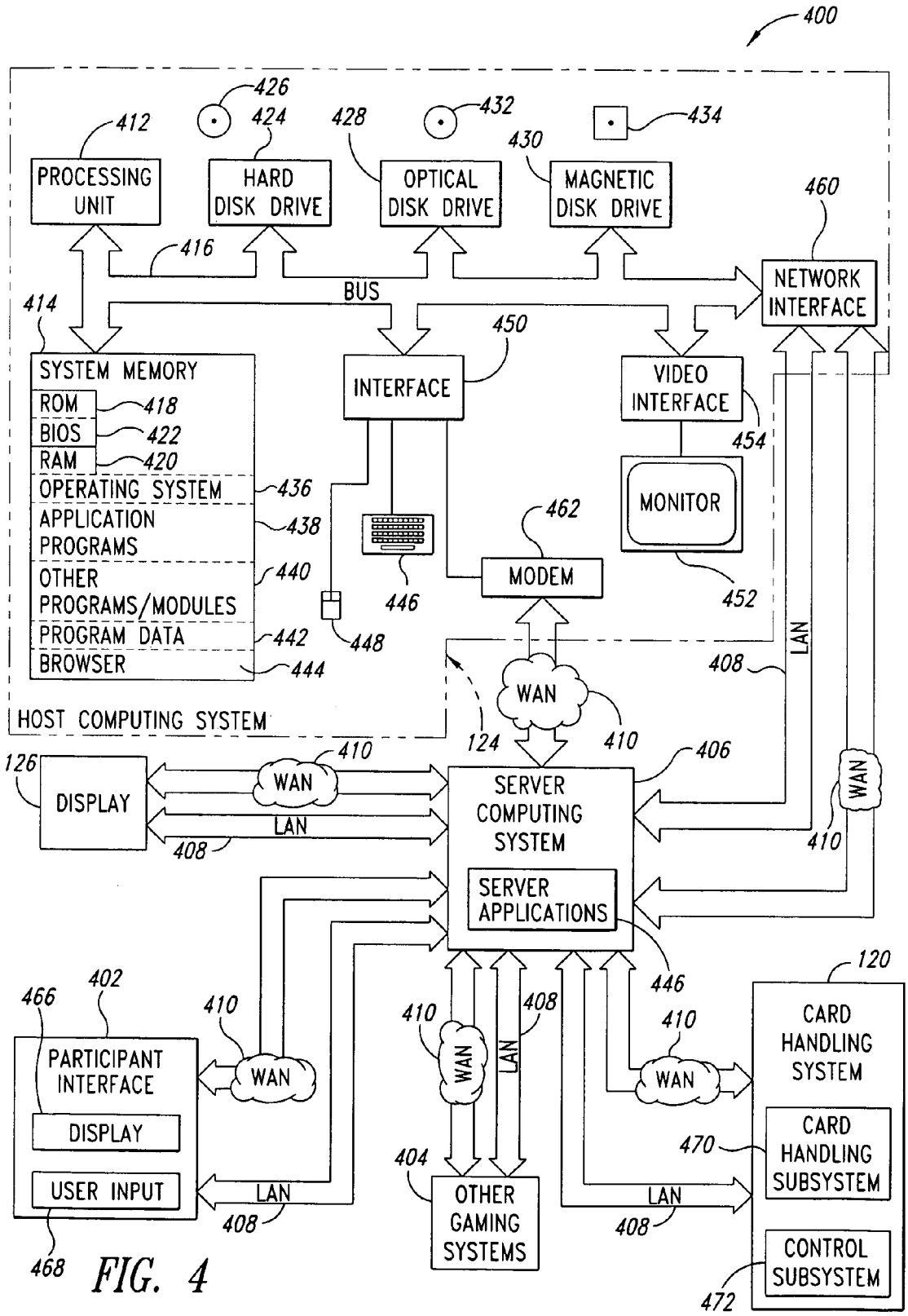
FIG. 4 is a schematic diagram of a gaming system, including a host computing system, gaming table system, participant interface, other gaming systems, and server computing system communicatively coupling at least some of the other elements, according to one illustrated embodiment.

FIG. 4 and the following discussion provide a brief, general description of a suitable computing environment 400 in which the various illustrated embodiments can be implemented. Although not required, the embodiments will be described in the general context of computer-executable instructions, such as program application modules, objects, or macros being executed by a computer. Those skilled in the relevant art will appreciate that the illustrated embodiments as well as other embodiments can be practiced with other computer system configurations, including hand-held devices, multiprocessor systems, microprocessor-based or programmable consumer electronics, personal computers ("PCs"), network PCs, mini computers, mainframe computers, and the like. The embodiments can be practiced in distributed computing environments where tasks or modules are performed by remote processing devices, which are linked through a communications network. In a distributed computing environment, program modules may be located in both local and remote memory storage devices.

FIG. 4 shows the computing environment 400 comprising one or more host computing systems 124, displays 126, participant interfaces 402, playing card handling systems 120, other gaming systems 404, and/or server computing systems 406 coupled by one or more communications channels, for example one or more local area networks (LANs) 408 or wide area networks (WANs) 410. The computing environment 400 may employ other computers, such as conventional personal computers, where the size or scale of the system allows.

The host computing system 124 may take the form of a conventional mainframe or mini-computer, that includes a processing unit 412, a system memory 414 and a system bus 416 that couples various system components including the system memory 414 to the processing unit 412. The host computing system 124 will at times be referred to in the singular herein, but this is not intended to limit the embodiments to a single host computing system since in typical embodiments, there will be more than one host computing system or other device involved.

The processing unit 412 may be any logic processing unit, such as one or more central processing units (CPUs), digital signal processors (DSPs), application-specific integrated circuits (ASICs), etc. Unless described otherwise, the construction and operation of the various blocks shown in FIG. 4 are of conventional design. As a result, such blocks need not be described in further detail herein, as they will be understood by those skilled in the relevant art.

The system bus 416 can employ any known bus structures or architectures, including a memory bus with memory controller, a peripheral bus, and a local bus. The system memory 414 includes read-only memory ("ROM") 418 and random access memory ("RAM") 420. A basic input/output system ("BIOS") 422, which can form part of the ROM 418, contains basic routines that help transfer information between elements within the host computing system 124, such as during start-up.

The host computing system 124 also includes a hard disk drive 424 for reading from and writing to a hard disk 426, and an optical disk drive 428 and a magnetic disk drive 430 for reading from and writing to removable optical disks 432 and magnetic disks 434, respectively. The optical disk 432 can be a CD-ROM, while the magnetic disk 434 can be a magnetic floppy disk or diskette. The hard disk drive 424, optical disk drive 428 and magnetic disk drive 430 communicate with the processing unit 412 via the system bus 416. The hard disk drive 424, optical disk drive 428 and magnetic disk drive 430 may include interfaces or controllers (not shown) coupled between such drives and the system bus 416, as is known by those skilled in the relevant art. The drives 424, 428 and 430, and their associated computer-readable media 426, 432, 434, provide nonvolatile storage of computer readable instructions, data structures, program modules and other data for the host computing system 124. Although the depicted host computing system 124 employs hard disk 424, optical disk 428 and magnetic disk 430, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 414, such as an operating system 436, one or more application programs 438, other programs or modules 440 and program data 442. The system memory 414 may also include communications programs for example a Web client or browser 444 for permitting the host computing system 124 to access and exchange data with sources such as Web sites of the Internet, corporate intranets, or other networks as described below, as well as other server applications on server computing systems such as those discussed further below. The browser 444 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as those from America Online and Microsoft of Redmond, Wash.

While shown in FIG. 4 as being stored in the system memory 414, the operating system 436, application programs 438, other programs/modules 440, program data 442 and browser 444 can be stored on the hard disk 426 of the hard disk drive 424, the optical disk 432 of the optical disk drive 428 and/or the magnetic disk 434 of the magnetic disk drive 430. An operator, such as casino personnel, can enter commands and information into the host computing system 124 through input devices such as a touch screen or keyboard 446 and/or a pointing device such as a mouse 448. Other input devices can include a microphone, joystick, game pad, tablet, scanner, etc. These and other input devices are connected to the processing unit 412 through an interface 450 such as a serial port interface that couples to the system bus 416, although other interfaces such as a parallel port, a game port or a wireless interface or a universal serial bus ("USB") can be used. A monitor 452 or other display device is coupled to the system bus 416 via a video interface 454, such as a video adapter. The host computing system 124 can include other output devices, such as speakers, printers, etc.

The host computing system 124 can operate in a networked environment using logical connections to one or more remote computers and/or devices, for example the server computing system 406. The server computing system 406 can be another personal computer, a server, another type of computer, or a collection of more than one computer communicatively linked together and typically includes many or all of the elements described above for the host computing system 124. The server computing system 406 is logically connected to one or more of the host computing systems 124 under any known method of permitting computers to communicate, such as through one or more LANs 408 and/or WANs 410 such as the Internet. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 124 is connected to the LAN 408 through an adapter or network interface 460 (communicatively linked to the system bus 416). When used in a WAN networking environment, the host computing system 124 may include a modem 462 or other device, such as the network interface 460, for establishing communications over the WAN 410. The modem 462 is shown in FIG. 4 as communicatively linked between the interface 450 and the WAN 410. In a networked environment, program modules, application programs, or data, or portions thereof, can be stored in the server computing system 406. In the depicted embodiment, the host computing system 124 is communicatively linked to the server computing system 406 through the LANs 408 and/or WAN 410, for example with TCP/IP middle layer network protocols. However, other similar network protocol layers are used in other embodiments, such as User Datagram Protocol ("UDP"). Those skilled in the relevant art will readily recognize that the network connections shown in FIG. 4 are only some examples of establishing communication links between computers, and other links may be used, including wireless links.

The server computing system 406 is also communicatively linked to one or more other computing systems or devices, such as the display 126, participant interface 402, playing card handling system 120 and/or other gaming systems 404, typically through the LAN 408 or the WAN 410 or other networking configuration such as a direct asynchronous connection (not shown).

The server computing system 406 includes server applications 464 for the routing of instructions, programs, data and agents between the host computing system 124, display 126, playing card handling system 120, participant interface 402, and/or other gaming systems 404. For example the server applications 464 may include conventional server applications such as WINDOWS NT 4.0 Server, and/or WINDOWS 2000 Server, available from Microsoft Corporation or Redmond, Wash. Additionally, or alternatively, the server applications 464 can include any of a number of commercially available Web servers, such as INTERNET INFORMATION SERVICE from Microsoft Corporation and/or IPLANET from Netscape.

The participant interface 402 may include one or more displays 466 and user input devices 468. The participant interface 402 may take the form of one or more of the displays 126*b*, 126*c* (FIGS. 1, 2). As discussed above, the displays 126 may take the form of touch screen displays. Alternatively, or additionally, the participant interface 402 may employ a separate user input device, for example a keyboard or keypad. The participant interface 402 may further include one or more sound transducers, such as a speaker and/or microphone.

The participant interface 402 may include one or more controllers, memories and may store and execute one or more applications for providing information to, and collecting information from the participants 110, 114 (FIGS. 1 and 2). For example, the players 110 may select payout or house odds and/or house advantage via the participant interface 402, for example via a GUI. The participant interface 402 may provide the player 110 with a selection of predefined payout or house odds and/or house advantages, or may receive payout or house odds and/or house advantage defined by the player 110. The participant interface 402 may permit the players 110 to select from a variety of bonus and/or progressive gaming options. Likewise, the participant interface 402 may provide the dealer 114 with the selected payout or house odds and/or house advantage for the various players 110, and may permit the dealer to enter the payout or house odds or house advantage for the various player positions 104.

Additionally, the participant interface 402 may include instructions for handling security such as password or other access protection and communications encryption. The participant interface 402 can also provide statistics (win, loss, time, etc.) to the players 110 and/or dealer 114. The statistics may be provided in real-time or almost real-time. Further, the participant interface 402 may allow the player 110 to request drinks, food, and/or services. The participant interface 402 may allow the dealer 114 to request assistance, for example requesting more chips or new playing cards. Other information may include one or more of player identification data, preference data, statistical data for the particular player and/or other players, account numbers, account balances, maximum and/or minimum wagers, etc.

Various playing card handling systems 120 are discussed in detail below, and may include one or more playing card handling subsystems 470 and one or more controller subsystems 472, which may include one or more programmed microprocessors, application specific integrated circuits (ASICs), memories or the like.

The other gaming systems 404 may include one or more sensors, detectors, input devices, output devices, actuators, and/or controllers such as programmed microprocessor and/or ASIC or the like. The controllers may execute one or more gaming applications. The gaming applications can include instructions for acquiring wagering and gaming event information from the live gaming at the gaming table 102 (FIGS. 1-3). The other gaming systems 404 may collect information via images (visible, infrared, ultraviolet), radio or microwave electromagnetic radiation, and/or by detecting magnetic, inductance, or mechanical energy. Such may be implemented in the card shoe 118, chip tray 122, or other areas at or proximate the gaming table 102. For example, the other gaming systems 404 may acquire images of the wagers 112 and/or identifiers on playing cards 116. The gaming applications can also include instructions for processing, at least partially, the acquired wagering and gaming event information, for example, identifying the position and size of each wager and/or the value of each hand of playing cards. The gaming applications may include statistical packages for producing statistical information regarding the play at a particular gaming table, the performance of one or more players, and/or the performance of the dealer 114 and/or game operator. The gaming applications can also include instructions for providing a video feed and/or simulation of some or all of the participant positions 104, 106. Gaming applications may determine, track, monitor or otherwise process outcomes of games, amounts of wagers, average wager, player identity information, complimentary benefits information ("comps"), player performance data, dealer performance data, chip tray accounting information, playing card sequences, etc. Some suitable applications are described in one or more of commonly assigned U.S. patent applications: Ser. No. 60/442,368, filed Apr. 21, 1999; Ser. No. 09/474,858 filed Dec. 30, 1999, entitled "METHOD AND APPARATUS FOR MONITORING CASINO GAMING"; Ser. No. 60/259,658, filed Jan. 4, 2001; Ser. No. 09/849,456 filed May 4, 2001, Ser. No. 09/790,480, filed Feb. 21, 2001, entitled "METHOD, APPARATUS AND ARTICLE FOR EVALUATING CARD GAMES, SUCH AS BLACKJACK".

Some embodiments may communicatively couple one or more of the systems 120, 124, 404, displays 126 and/or participant interfaces 402 without the use of the server computing system 406, or alternatively via multiple server computing systems.

Structural Aspects of the Playing Card Handling Systems

Figure 5A:
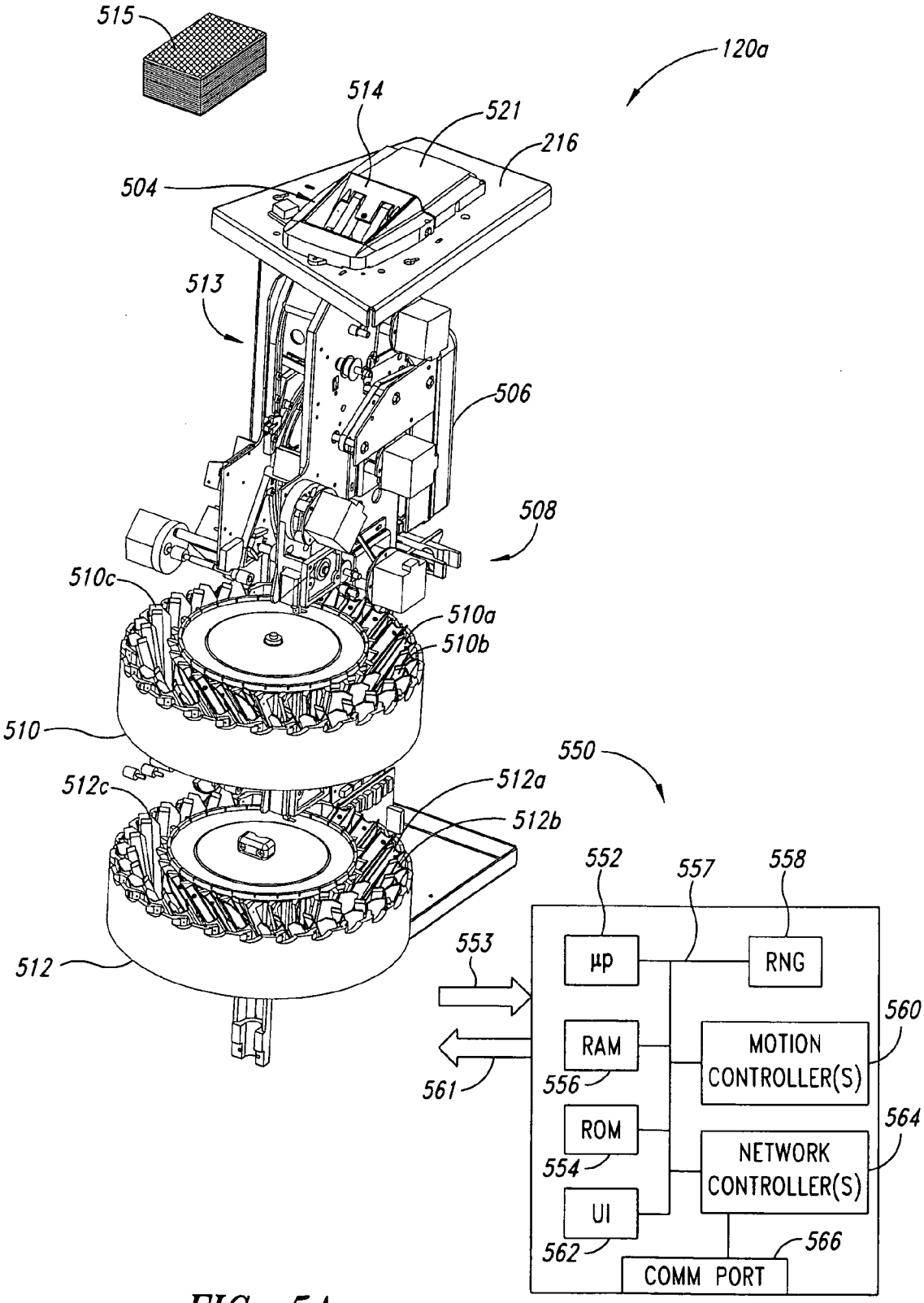
FIG. 5A is an isometric view of a playing card handling system according to one illustrated embodiment.
Figure 5B:
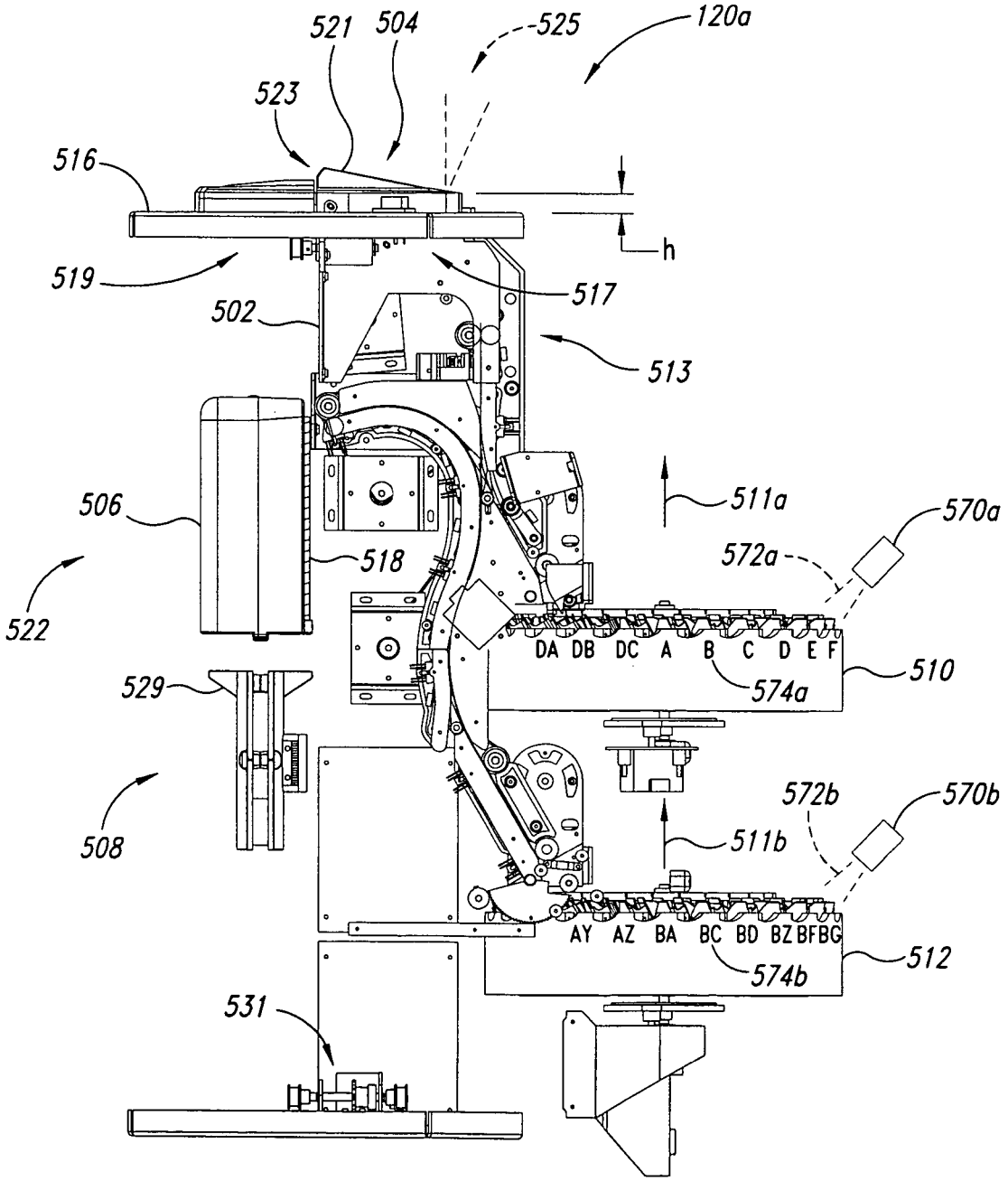
FIG. 5B is an isometric view of a playing card handling system of FIG. 5A.

FIGS. 5A and 5B show a playing card handling system 120*a* for handling playing cards according to one illustrated embodiment. As explained in detail below, the playing card handling system 120*a* is operable to provide one or more sets of randomized playing cards for use in a card game, based at least in part on selected payout or house odds and/or house advantage.

The playing card handling system 120*a* can be coupled to or installed with or near the gaming table 102 (FIGS. 1-3). In one embodiment, the playing card handling system 120*a* is installed away from the gaming table 102, for example, in a restricted area of a casino where decks of playing cards are received and shuffled.

The playing card handling system 120*a* includes a structural frame 502, a playing card input receiver 504, a playing card output receiver 506, a card elevator mechanism 508, a first intermediary playing card receiver 510, and an optional, second intermediary playing card receiver 512. The playing card handling system 120*a* may be partially or fully enclosed by a housing (not shown) and/or by the gaming table 102 (FIGS. 1-3).

At least one playing card reading sensor 513 is positioned between the playing card input receiver 504 and the playing card output receiver 506. The playing card reading sensor is operable to read identifying information form the playing cards. The information allows the playing cards to be identified, for example by rank and/or suit, or other values such as a point value of the playing card. The playing card reading sensor 513 may, for example, take the form an optical machine-readable symbol reader, operable to read non-standard playing card markings from the playing cards, for example machine-readable symbols such as barcode, matrix or area code, or stacked code symbols. The playing card reading sensor 513 may be operable to read standard playing card markings (e.g., rank, suit, pips). Such optical machine-readable symbol readers may take the form of a scanner or an imager. The playing card reading sensor 513 may take the form of a magnetic strip reader or inductive sensor to read magnetic stripe or other indicia carried on or in the playing cards. The playing card reading sensor 513 may take the form of an radio frequency reader, for example an radio frequency identification (RFID) interrogator where the playing cards carry RFID tags or circuits. The playing card reading sensor 513 may, for example, read playing cards one at a time as the playing cards pass the playing card reading sensor 513 while traveling along the playing card transport path 509.

The playing card reading sensor 513 may be positioned between the input card receiver 504 and the intermediary playing card receivers 510, 512. This allows the playing card handling system 120*a* to sort playing cards into appropriate ones of the first and the second intermediary playing card receivers 510, 512, or within selected ones of compartments or receptacles of the first and the second intermediary playing card receivers 510, 512.

The playing card input receiver 504 is sized and positioned to receive playing cards collected at the end of a hand or game (i.e., collected playing cards 515), which are to be randomized or otherwise handled. The collected playing cards 515 may be collected from the gaming table 102 during play or after a card game or round has been played. The playing card input receiver 504 may be carried or formed by a plate 516, which may be in turn be carried by, coupled to, or otherwise connected to the gaming table 102. The playing card input receiver 504 may include a card input ramp 514 on to which the collected playing cards 515 may be fed by a dealer or other person, as individual cards or as a group of cards. An input passage 517 extends through the plate 516 and the playing surface of the gaming table 102 (FIGS. 1-3) to allow passage of the collected playing cards 515 from the playing card input receiver 504 to the playing card transport path of the playing card handling system 120*a*.

The first and second intermediary playing card receivers 510, 512 may take the form of carousels, each pivotally mounted about respective vertical axes 511*a*, 511*b* (FIG. 5B), which are vertical with respect to gravity or a base. Carousels may advantageously employ bi-directional rotational motion, in contrast to racks or trays, which typically require translation. The vertical axes 511*a*, 511*b* may advantageously be coaxial, thereby minimizing the area or "footprint" of the playing card handling system 120*a*. The first and second intermediary playing card receivers 510, 512 include a plurality of card receiving compartments, each of the compartments sized to hold a respective playing card. For example, there may be sufficient compartments to hold two or more decks of playing cards. Also for example, the first intermediary playing card receiver 510 may include a plurality of playing card receiving compartments 510*a*, 510*b*, 510*c* (e.g., 180, only three called out in FIG. 5A), each sized to hold a respective playing card. Also for example, the second intermediary playing card receiver 512 may include a plurality of playing card receiving compartments 512*a*, 512*b*, 512*c* (e.g., 180, only three called out in Figure) each sized to hold a respective playing card. The number of card receiving compartments, as well as the number of inventory playing cards (i.e., playing cards in the playing card handling system 120*a*) can be greater or lesser than the illustrated embodiment. In addition, the number of intermediary playing card receptacles 510, 512 may be greater or lesser than the two shown in the illustrated embodiment.

The term "carousel" as used herein is intended to be a generic term for a structure that comprises an endless plurality of physical playing card receptacles, referred to as card receiving compartments for convenience, particularly suited for rotational movement. Some embodiments may employ other card storage devices, for example a rack having a generally rectangular structure of card receiving compartments, mounted for translation. The rack may, for example, be vertically-oriented. An wedge or portion of an annulus shaped structure of card receiving compartments, mounted for pivoting. It is appreciated that the various types of structures and/or orientations employing card receiving compartments are too numerous to describe in detail herein. Furthermore, such structures may be moved in any suitable direction, orientation and/or manner. Any such structure and/or orientation comprising a plurality of card receiving compartments configured to be a repository for inventory cards are intended to be included within the scope of this disclosure.

In one embodiment, playing cards may be loaded from the playing card input receiver 504 to one of the intermediary playing card receivers 510, 512 while concurrently unloading playing cards to the playing card output receiver 506 from the other of the intermediary playing card receivers 510, 512. This advantageously reduces any delay in providing playing cards to the gaming table 102. The first and second intermediary playing card receivers 510, 512 may be removable, allowing fresh playing cards to be loaded into the playing card handling system 120*a*. Loading of fresh playing cards may occur while the playing card handling system 102*a* is building a set of playing cards in the output receiver from the previously loaded intermediary playing card receiver 510, 512.

The playing card output receiver 506 is sized to receive a plurality of randomized playing cards 518 (e.g., 2-8 decks or 110-416 playing cards). As illustrated, the playing card output receiver 506 may take the form of a cartridge or rectangular box with a floor, and open, for example, on one or more sides to allow placement and removal of the randomized playing cards 518. The playing card output receiver 506 may pass through an output passage 519 that extends through the plate 516 and the playing surface of the gaming table 102 (FIGS. 1-3), to allow the card elevator mechanism 508 to deliver the randomized playing cards 518 to the gaming table 102.

In one embodiment, the playing card handling system 120*a* is located completely below the playing surface of the gaming table 102. In another embodiment, a vertical sidewall formed around the playing card input receiver 504 and the output passage 519 has a height "h." The height "h" corresponds to a thickness of the gaming table top such that the top portions of the playing card input receiver 504 and the output passage 519 may be flush with or extend just a little bit above (e.g., low profile) the playing surface of the gaming table 102 (FIGS. 1-3). The playing surface of the gaming table 102 typically comprises a felt cover on top of a foam pad, both of which are positioned on top of a sheet of composite, wood, or other type of material. One type of suitable surface 104 is described in detail in U.S. patent application Ser. No. 10/981,132. Some embodiments may omit the plate 516, and form the passages 517, 519 only through the playing surface of the gaming table 102. Still other embodiments may not locate the playing card handling system 120*a* under the playing surface of the playing table 102, thus such embodiments may omit the passages 517, 519 through the gaming table 102. To conserve space, in one embodiment the playing card input receiver 504 and the output passage 519 are positioned adjacent to one another.

Depending upon the embodiments and/or the type of card game, the randomized playing cards 518 may be delivered individually or as a group of cards. Embodiments of the playing card handling system 120*a* may be user configurable to provide randomized playing cards 518 having any specified number of playing cards, and/or any specified suit of cards, and/or any specified rank(s) of cards, and/or other cards such as bonus cards or the like.

A cover 521 may be manually moved from a closed position 523 to an opened position 525 (FIG. 5B, broken line), where in the closed position 523 the cover 521 is disposed over the output passage 519 so as to limit or preclude access or a view into the output passage 519, and where in the opened position 525 the cover 521 is spaced from the output passage 519 so as to not limit nor preclude access or a view into the output passage 519. The cover 521 may be pivotally or slideably coupled to the frame 502, plate 516 or other portion of the playing card handling system 120*a* for movement between the closed and the opened positions. In particular, the cover 521 may be pivotally coupled to the frame or other portion of the playing card handling system 120*a* for movement between the closed and the opened positions, 523, 525, respectively. Alternatively, the cover 521 may be slideably or pivotally coupled directly to the gaming table 102.

The playing card output receiver 506 is moveable between a lowered position 522 and a raised position (not shown). In the raised position, at least a portion of the playing card output receiver 506 is positioned to permit the randomized playing cards 518 to be withdrawn from the playing card output receiver 506 by a dealer 114 (FIGS. 1 and 2) or another person at the gaming table 102. For example, the raised position may, for example, be spaced sufficiently above the plate 516 to expose all or some of the randomized playing cards 518 above the surface 104 of the gaming table 102 (FIGS. 1-3). In the lowered position 522, the playing card output receiver 506 is positioned such that the randomized playing cards 518 cannot be withdrawn from the playing card output receiver 506. For example, a top of the playing card output receiver 506 may be spaced flush with, or below the playing surface of the gaming table 102 and/or below a top of the plate 516.

The card elevator mechanism 508 moves the playing card output receiver 506 between the lowered position 552 and the raised position. The card elevator mechanism 508 may, for example, comprise a linkage 529 and an elevator motor 531 coupled to drive the linkage 529. FIGS. 5A and 5B employ a partially exploded view, showing the playing card output receiver 506 spaced from linkage 529 of the card elevator mechanism 508 to better illustrate the components. In use, the playing card output receiver 506 will be physically connected or coupled to the linkage 529. In one embodiment, the elevator motor 531 is a DC stepper motor. Alternatively, the elevator motor 531 may take the form of a servo-motor. The card elevator mechanism 508 may employ any suitable linkage, including but not limited to a belt, sprocket chain, gear, scissors linkage or the like (not shown for clarity). Activation of the elevator motor 531 moves the linkage 529 and the playing card output receiver 506 relative to the structural frame 502.

After the playing card output receiver 506 delivers the randomized playing cards 518 to the gaming table 102, the card elevator mechanism 508 returns the playing card output receiver 506 to the lowered position 522. The lowered position 522 may be aligned with an elevator branch.

In some embodiments, one or more external switches (not called out) are positioned to be accessible from an exterior of the playing card handling system 120*a*. The external switches may, for example, be carried by the plate 516, the playing surface of the gaming table 102, or a housing (not shown) of the playing card handling system 102*a*. The external switches may be selectively activated to cause the card elevator mechanism 508 to move the playing card output receptacle 506 to the lowered position 522. Additionally, or alternatively, the external switches may be selectively activated to cause the card elevator mechanism 508 to move the playing card output receptacle 506 to the raised position. In some embodiments, a cover switch (not called out) is responsive to movement and/or a position of the cover 521 to cause the card elevator mechanism 508 to automatically move the playing card output receiver 506 upward from the lowered position 522 to the raised position. Additionally or alternatively, the cover switch is responsive to movement and/or a position of the cover 521 to cause the card elevator mechanism 508 to automatically move the playing card output receiver 506 downward from the raised position to the lowered position 522. The cover switch 233 may be employed in addition to, or in place of, the external switches 231. The cover switch 233 may take the form of a contact switch or sensor such as a proximity sensor, light sensor, infrared sensor, pressure sensor, or magnetic sensor such as a Reed switch.

One or more lowered position sensors (not shown) may detect when the playing card output receiver 506 is at the lowered position 522. The lowered position sensors may take a variety of forms including, but not limited to a proximity sensor, optical eye type sensor, and/or positional or rotational encoder. The lowered position sensors 235 may sense the position of the playing card output receiver 506, or the linkage 529 or shaft of elevator motor 531.

Some embodiments may employ an interlock or lockout feature. The lockout feature prevents the card elevator mechanism 508 from moving the playing card output receptacle 506 to the raised position until the playing card output receptacle 506 is loaded with a sufficient number of randomized playing cards 518. For example, the lockout feature may keep the playing card output receptacle 506 in the lowered position 522 until at least one hundred and twelve cards (e.g., two standard decks) have been loaded in the playing card output receptacle 506.

The playing card handling system 120*a* may include a control subsystem 550 (FIG. 5A). The control subsystem 550 may include one or more controllers, processors, ASIC and/or memories. For example, the control subsystem 550 may include a microprocessor 552, ROM 554 and RAM 556 coupled via one or more buses 557. The microprocessor 552 may employ signals 553 received from one or more sensors or actuations of the playing card handling system 120*a*.

The control subsystem 550 may also include one or more motor controllers 560 to send control signals 561 to control operation of the various motors and/or actuators of the playing card handling system 120*a*.

The control subsystem 550 may also include one or more user interfaces 562 to provide information to, and/or receive information from a user, for example the dealer 114 (FIGS. 1 and 2). Any known or later developed user interface may be suitable, for example a touch screen display, keyboard, and/or keypad, voice activated, etc.

The control subsystem 550 may include one or more network controllers 564 and/or communications ports 566 for providing communications via communications channels, for example LANs 408 (FIG. 4) and/or WANs 410.

The control subsystem 550 may also include one or more random number generators 558. While illustrated as a dedicated device, in some embodiments the random number generator functionality may be implemented by the microprocessor 552. As discussed in detail below, the random number generator 558 produces a random numbers or virtual playing card values based at least in part on the selected payout or house odds and/or house advantage.

The playing card handling system 120*a* may include one or more inventory card sensors 570*a*, 570*b* positioned and operable to detect identifiers carried by each playing card at least partially received in one of the playing card receiving compartments 510*a*-510*c*, 512*a*-512*c* of the one or more intermediary playing card receivers 510, 512. The inventory card sensors 570*a*, 570*b* may take the form of an optical sensor, for example an image sensor such as a one- or two-dimensional array of charge coupled devices (CCDs) or may take the form of a scan sensor, for example one or more photodiodes, vidicons, or photo-multipliers. Such optical inventory card sensors 570*a*, 570*b* may capture an image of a portion of a playing card in each playing card receiving compartment that is within a field-of-view 572 of the inventory card sensor 570*a*, 570*b*. The inventory card sensor 570*a*, 570*b* may also capture an image of an playing card compartment identifier 574*a*, 574*b* (only two called out in Figure), which may take the form of a marking on or proximate one or more of the playing card receiving compartments 510*a*-510*c*, 512*a*-512*c*. The playing card compartment identifiers 574*a*, 574*b* indicate the position of the particular playing card receiving compartment 510*a*-510*c*, 512*a*-512*c* with respect to the other playing card receiving compartments 510*a*-510*c*, 512*a*-512*c*. The playing card compartment identifiers 574*a*, 574*b* may take the form of numbers, letters, or other markings, which may, or may not be visible. Alternatively, or additionally, the playing card handling system 120*a* may employ a positional or rotational encoder to track the position of the playing card receiving compartments 510*a*-510*c*, 512*a*-512*c* relative to the inventory card sensors 570*a*, 570*b*. The playing card handling system 120*a* may employ other forms of inventory card sensors 570*a*, 570*b*, for example radio frequency identification interrogators, magnetic stripe readers, inductive sensors, etc.

The playing card handling system 120*a* may employ the inventory card sensors 570*a*, 570*b* to advantageously confirm that the playing cards in the respective the playing card receiving compartments 510*a*-510*c*, 512*a*-512*c* are the expected playing cards. The playing card handling system 120*a* may employ the inventory card sensors 570*a*, 570*b* to inventory the intermediary playing card receivers 510, 512, for example in response to detection of an actual or possible anomalous operating condition, or in response to a user input. This may advantageously eliminate the need to refill the intermediary playing card receivers 510, 512 on the occurrence of an anomaly. Such may significantly reduce the amount of time to provide a new set of randomized playing cards at the playing card output receiver 506. The playing card handling system 120*a* may, or may not, return playing cards to the intermediary playing card receiver 510, 512 from the playing card output receiver 506 before performing the inventory of the intermediary playing card receiver 510, 512.

Figure 6A:
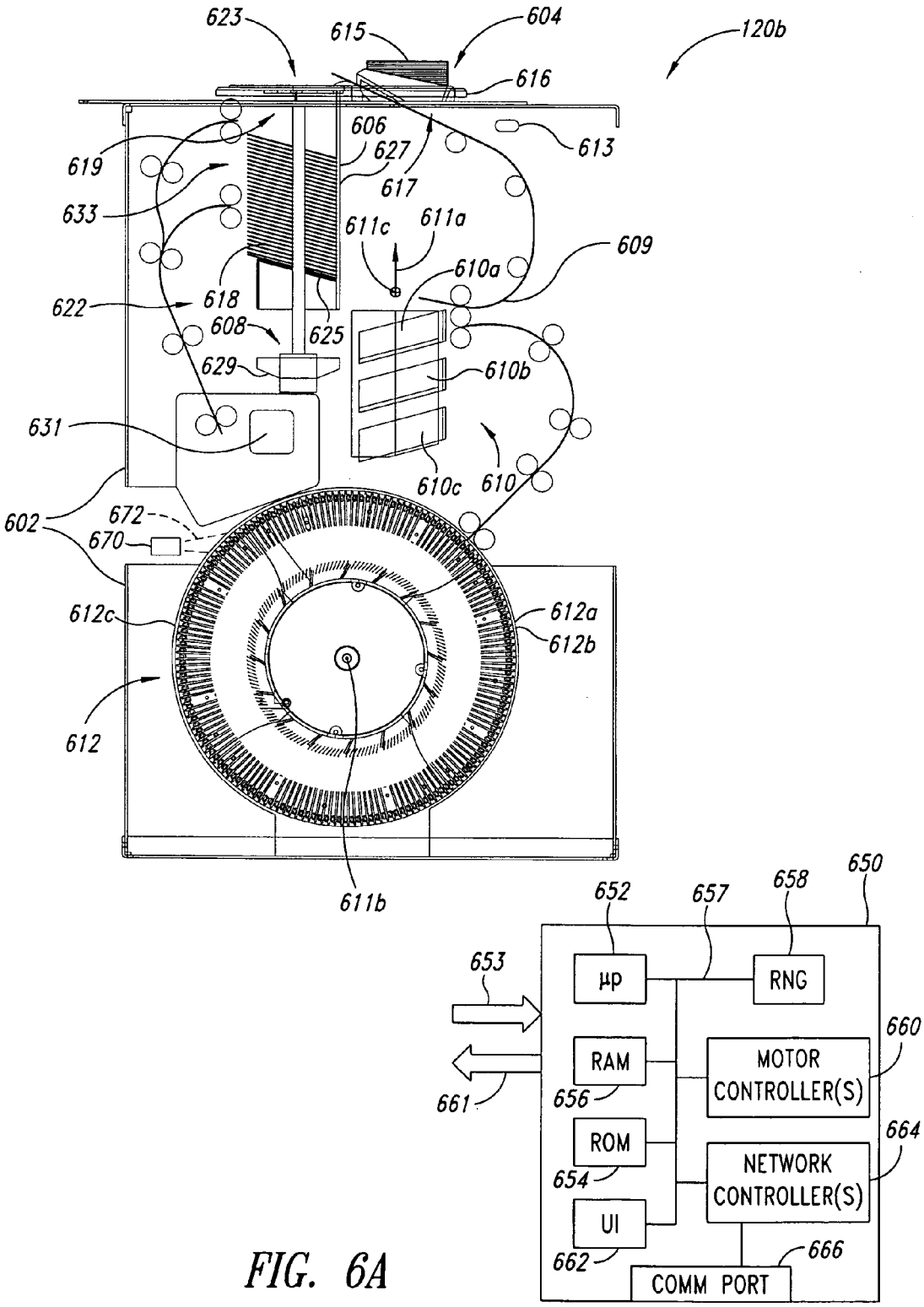
FIG. 6A is a side elevational view of a playing card handling system according to another illustrated embodiment.

FIG. 6A shows a playing card handling system 120*b* for handling playing cards according to another illustrated embodiment. As explained in detail below, the playing card handling system 120*b* is operable to provide one or more sets of randomized playing cards for use in a card game, based at least in part on selected payout or house odds and/or house advantage.

The playing card handling system 120*b* can be coupled to or installed with or near the gaming table 102 (FIGS. 1-3). In one embodiment, the playing card handling system 102*b* is installed away from the gaming table 102, for example, in a restricted area of a casino where decks of playing cards are received and shuffled.

The playing card handling system 120*b* includes a structural frame 602, a playing card input receiver 604, a playing card output receiver 606, a card elevator mechanism 608, a first intermediary playing card receiver 610, and a second intermediary playing card receiver 612. The playing card handling system 120*b* may be partially or fully enclosed by a housing (not shown) and/or by the gaming table 102 (FIGS. 1-3).

At least one playing card reading sensor 613 is positioned between the playing card input receiver 604 and the playing card output receiver 606. The playing card reading sensor is operable to read identifying information form the playing cards. The information allows the playing cards to be identified, for example by rank and/or suit, or other values such as a point value of the playing card. The playing card reading sensor 613 may, for example, take the form an optical machine-readable symbol reader, operable to read machine-readable symbols (e.g., barcode, matrix or area codes, or stacked codes) from the playing cards. The playing card reading sensor 613 may be operable to read standard playing card markings (e.g., rank, suit, pips). Such optical machine-readable symbol readers may take the form of a scanner or an imager. The playing card reading sensor 613 may take the form of a magnetic strip reader or inductive sensor to read magnetic stripe or other indicia carried on or in the playing cards. The playing card reading sensor 613 may take the form of an radio frequency reader, for example an radio frequency identification (RFID) interrogator where the playing cards carry RFID tags or circuits. The playing card reading sensor 613 may, for example, read playing cards one at a time as the playing cards pass the playing card reading sensor 613 while traveling along the playing card transport path 609.

The playing card reading sensor 613 may be positioned between the input card receiver 604 and the intermediary playing card receivers 610, 612. This allows the playing card handling system to sort playing cards into appropriate ones of the first and/or the second intermediary playing card receivers 610, 612, or card receiving compartments or receptacles therein.

The playing card input receiver 604 is sized and positioned to receive playing cards collected at the end of a hand or game (i.e., collected playing cards 615), which are to be randomized or otherwise handled. The collected playing cards 615 may be collected from the gaming table 102 during play or after a card game or round has been played. The playing card input receiver 604 may be carried or formed by a plate 616, which may be in turn be carried by, coupled to, or otherwise connected to the gaming table 102. The playing card input receiver 604 may include a card input ramp (not shown) on to which the collected playing cards 615 may be fed by a dealer or other person, as individual cards or as a group of cards. An input passage 617 extends through the plate 616 and the playing surface of the gaming table 102 (FIGS. 1-3) to allow passage of the collected playing cards 615 from the playing card input receiver 604 to the playing card transport path of the playing card handling system 120*b*.

The first intermediary playing card receiver 610 may take the form of one or more (e.g., three) distinct playing card receiving compartments 610*a*, 610*b*, 610*c*, each sized to receive a plurality of playing cards therein. The first intermediary playing card receiver 610 may be moveable with respect to a playing card input path 609 that extends from the playing card input receiver 604. As illustrated, the first intermediary playing card receiver 610 may be translatable along a vertical axis 611*a* with respect to the playing card transport path 609. Alternatively, the first intermediary playing card receiver 610 may be rotatable or pivotally moveable about a horizontal axis 611*c* (cross illustrating axis going into page of drawing sheet) with respect to the playing card transport path 609. In such an embodiment, the first intermediary playing card receiver 610 may have an approximately annular profile.

The second intermediary playing card receiver 612 may take the form of a carousel, pivotally mounted about a horizontal axis 611*b*. Carousels may advantageously employ bidirectional rotational motion, in contrast to racks or trays, which typically require translation. The second intermediary playing card receiver 612 may include a plurality of card receiving compartments, each of the card receiving compartments sized to hold a respective playing card. For example, there may be sufficient compartments to hold two or more decks of playing cards. For example, the first intermediary playing card receiver 610 may include three playing card receiving compartments each sized to hold a plurality of playing cards (e.g., 110 playing cards each). Also for example, the second intermediary playing card receiver 612 may include a plurality of playing card receiving compartments (e.g., 180) each sized to hold a respective playing card.

The number of card receiving compartments, as well as the number of inventory playing cards (i.e., playing cards in the playing card handling system 120*a*) can be greater or lesser than the illustrated embodiment. In addition, the number of intermediary playing card receivers 610, 612 may be greater or lesser than that shown in the illustrated embodiment.

In one embodiment, playing cards are loaded from the playing card input receiver 604 to one of the intermediary playing card receivers 610, 612 based on when the particular playing card will be required to build a set of playing cards based on a random sequence of virtual playing card values. Thus, for example, a set of virtual playing card values may be generated or otherwise formed. The set may be divided into two or more subsets. For example, where the first intermediary playing card receiver has three distinct card receiving compartments 610*a*-610*c*, the set may be divided into four subsets, one for each of the playing card compartments 610*a*-610*c* of the first intermediary playing card receiver 610, and one for the second intermediary playing card receiver 612. The resulting subsets do not necessarily have to be of equal size. Playing cards that will required the earliest (e.g., those in the first quarter of the set of virtual playing card values) will be transported directly to the second intermediary playing card receiver 612. Playing card required next (e.g., those in the second quarter of the set of virtual playing card values) may be loaded into a first one of the compartments 610*a* of the first playing card receiver 610. Playing card required next (e.g., those in the third quarter of the set of virtual playing card values) may be loaded into a second one of the compartments 610*b* of the first playing card receiver 610, while playing cards required last (e.g., those in the fourth quarter of the set of virtual playing card values) may be loaded into a third one of the compartments 610*c* of the first playing card receiver 610.

After, or while the second intermediary playing card receiver 612 is being emptied, playing cards from the first card receiving compartment 610*a*, then from the second card receiving compartment 610*b* and finally from the third card receiving compartment 610*c* may be loaded into compartments of the second playing card receiver 612. During this process, the playing card handling system 120*b* knows or tracks the position or location of each playing card, having initially identified the playing cards with the playing card reading sensor 613, and tracking the various destinations of the playing cards. In some embodiments, playing cards are loaded concurrently with unloading of the playing cards.

This multiple intermediary card receiver approach allows the playing card handling system 120*b* to handle a very large number of playing cards without incurring unacceptable delays in providing randomized playing card to the gaming table 102. The first and/or the second intermediary playing card receivers 610, 612 may be removable allowing fresh playing cards to be loaded into the playing card handling system 120*b*. Loading of fresh playing cards may occur while the playing card handling system 120*b* is building a set of playing cards in the output receiver from the previously loaded intermediary playing card receiver 610, 612.

The playing card output receiver 606 is sized to receive a plurality of randomized playing cards 618 (e.g., 2-8 decks or 110-416 playing cards). As illustrated, the playing card output receiver 606 may take the form of a cartridge or rectangular box with a floor 625, and open, for example, on one or more sides to allow placement and removal of the randomized playing cards 618. The floor 625 may be sloped to upward from a closed side or rear 627 of the playing card output receiver 606 to a front or opened side 633 of the playing card output receiver 606. Such may advantageously retain the plurality of randomized playing cards 618 in the playing card output receiver 606 as the playing card output receiver 606 moves and/or as when the playing card output receiver 606 is above the surface of the gaming table 102. The playing card output receiver 606 may pass through an output passage 619 that extends through the plate 616 and the playing surface of the gaming table 102 (FIGS. 1-3), to allow the card elevator mechanism 608 to deliver the randomized playing cards 618 to the gaming table 102.

In one embodiment, the playing card handling system 120*b* is located completely below the playing surface of the gaming table 102. In another embodiment, the top portions of the playing card input receiver 604 and the output passage 619 may be flush with or extend just a little bit above the playing surface of the gaming table 102 (FIGS. 1-3). Still other embodiments may not locate the card handling system 120*b* under the playing surface of the playing table 102, thus such embodiments may omit the passages 617, 619 through the gaming table 102. To conserve space, in one embodiment the playing card input receiver 604 and the output passage 619 are positioned adjacent to one another.

Depending upon the embodiments and/or the type of card game, the randomized playing cards 618 may be delivered individually or as a group of cards. Embodiments of the playing card handling system 120*b* may be user configurable to provide randomized playing cards 618 having any specified number of playing cards, and/or any specified suit of cards, and/or any specified rank(s) of cards, and/or other cards such as bonus cards or the like.

As discussed in reference to the embodiment of FIGS. 5A and 5B, the playing card handling system 120*b* may include a cover 621 that is manually moved from a closed position 623 to an opened position (not shown in FIG. 6A), where in the closed position 623 the cover 621 is disposed over the output passage 619 so as to limit or preclude access or a view into the output passage 619, and where in the opened position the cover 621 is spaced from the output passage 619 so as to not limit nor preclude access or a view into the output passage 619. The cover 621 may be pivotally or slideably coupled to the frame 602, plate 616 or other portion of the playing card handling system 120*b*. Alternatively, the cover 621 may be slideably or pivotally coupled directly to the gaming table 102.

As discussed in reference to the embodiment of FIGS. 5A and 5B, the playing card handling system 120*b*, the playing card output receiver 606 is moveable between a lowered position 622 and a raised position (not shown). In the raised position, at least a portion of the playing card output receiver 606 is positioned to permit the randomized playing cards 618 to be withdrawn from the playing card output receiver 606 by a dealer 114 (FIGS. 1 and 2) or another person at the gaming table 102. In the lowered position 622, the playing card output receiver 606 is positioned such that the randomized playing cards 618 cannot be withdrawn from the playing card output receiver 606.

The card elevator mechanism 608 moves the playing card output receiver 606 between the raised and the lowered positions. The card elevator mechanism 608 may, for example, comprise a linkage 629 and an elevator motor 631 coupled to drive the linkage 629. FIG. 6A employs a partially exploded view, showing the playing card output receiver 606 spaced from linkage 629 to better illustrate the components. In use, the playing card output receiver 606 will be physically connected or coupled to the linkage 629. The elevator motor 631 may take the form of a DC stepper motor or alternatively a servo-motor.

After the playing card output receiver 606 delivers the randomized playing cards 618 to the gaming table 102, the card elevator mechanism 608 returns the playing card output receiver 606 to the lowered position 622. The lowered position 622 may be aligned with an elevator branch.

As discussed in reference to the embodiment of FIGS. 5A and 5B, in some embodiments of the playing card handling system 120*b*, one or more external switches (not called out) are positioned to be accessible from an exterior of the playing card handling system 120*b*. The external switches may, for example, be carried by the plate 616, the playing surface of the gaming table 102, or a housing (not shown) of the playing card handling system 102*a*. The external switches may be selectively activated to cause the card elevator mechanism 608 to move the playing card output receiver 606 to the lowered position 622. Additionally, or alternatively, the external switches may be selectively activated to cause the card elevator mechanism 608 to move the playing card output receiver 606 to the raised position. In some embodiments, a cover switch (not called out) is responsive to movement and/or a position of the cover 621 to cause the card elevator mechanism 608 to automatically move the playing card output receiver 606 upward from the lowered position 622 to the raised position. Additionally or alternatively, the cover switch is responsive to movement and/or a position of the cover 621 to cause the card elevator mechanism 608 to automatically move the playing card output receiver 606 downward from the raised position to the lowered position 622. The cover switch 233 may be employed in addition to, or in place of, the external switches 231. The cover switch 233 may take the form of a contact switch or sensor such as a proximity sensor, light sensor, infrared sensor, pressure sensor, or magnetic sensor such as a Reed switch.

One or more lowered position sensors (not shown) may detect when the playing card output receiver 606 is at the lowered position 622. The lowered position sensors may take a variety of forms including, but not limited to a proximity sensor, optical eye type sensor, and/or positional or rotational encoder. The lowered position sensors may sense the position of the playing card output receiver 606, or the linkage 629 or shaft of elevator motor 631.

Some embodiments may employ an interlock or lockout feature. The lockout feature prevents the card elevator mechanism 608 from moving the playing card output receiver 606 to the raised position until the playing card output receiver 606 is loaded with a sufficient number of randomized playing cards 618. For example, the lockout feature may keep the playing card output receiver 606 in the lowered position 622 until at least one hundred and twelve cards (e.g., two standard decks) have been loaded in the playing card output receiver 606.

The playing card handling system 120*b* may include a control subsystem 650. The control subsystem 650 may include one or more controllers, processors, ASIC and/or memories. For example, the control subsystem 650 may include a microprocessor 652, ROM 654 and RAM 656 coupled via one or more buses 657. The microprocessor 652 may employ signals 553 received from one or more sensors or actuations of the playing card handling system 120*b*.

The control subsystem 650 may also include one or more motor controllers 660 to send control signals 661 to control operation of the various motors and/or actuators of the playing card handling system 120*b*.

The control subsystem 650 may also include one or more user interfaces 662 to provide information to, and/or receive information from a user, for example the dealer 114 (FIGS. 1 and 2). Any known or later developed user interface may be suitable, for example a touch screen display, keyboard, and/or keypad.

The control subsystem 650 may include one or more network controllers 664 and/or communications ports 666 for providing communications via communications channels, for example LANs 408 (FIG. 4) and/or WANs 410.

The control subsystem 650 may also include one or more random number generators 658. While illustrated as a dedicated device, in some embodiments the random number generator functionality may be implemented by the microprocessor 652. As discussed in detail below, the random number generator 658 produces a random numbers or virtual playing card values based at least in part on the selected payout odds or house advantage.

The playing card handling system 120*a* may include one or more inventory card sensors 67 positioned and operable to detect identifiers carried by each playing card at least partially received in one of the playing card receiving compartments 612*a*-612*c* of the one or more intermediary playing card receivers 610, 612. The inventory card sensor 670 may take the form of an optical sensor, for example an image sensor such as a one- or two-dimensional array of charge coupled devices (CCDs) or may take the form of a scan sensor, for example one or more photodiodes, vidicons, or photo-multipliers. Such optical inventory card sensor 670 may capture an image of a portion of a playing card in each playing card receiving compartment that is within a field-of-view 672 of the inventory card sensor 670. The inventory card sensor 670 may also capture an image of an playing card compartment identifier 574 (shown in FIG. 5B), which may take the form of a marking on or proximate one or more of the playing card receiving compartments 612*a*-612*c*. The playing card compartment identifiers indicate the position of the particular playing card receiving compartment 612*a*-612*c* with respect to the other playing card receiving compartments 612*a*-612*c*. The playing card compartment identifiers may take the form of numbers, letters, or other markings, which may, or may not be visible. Alternatively, or additionally, the playing card handling system 120*a* may employ a positional or rotational encoder to track the position of the playing card receiving compartments 612*a*-612*c* relative to the inventory card sensors 670. The playing card handling system 120*a* may employ other forms of inventory card sensors 670, for example radio frequency identification interrogators, magnetic stripe readers, inductive sensors, etc.

The playing card handling system 120*a* may employ the inventory card sensors 670 to advantageously confirm that the playing cards in the respective the playing card receiving compartments 612*a*-612*c* are the expected playing cards. The playing card handling system 120*a* may employ the inventory card sensors 670 to inventory the intermediary playing card receivers 612, for example in response to detection of an actual or possible anomalous operating condition, or in response to a user input. This may advantageously eliminate the need to refill the intermediary playing card receivers 612 on the occurrence of an anomaly. Such may significantly reduce the amount of time to provide a new set of randomized playing cards at the playing card output receiver 606. The playing card handling system 120*a* may, or may not, return playing cards to the intermediary playing card receiver 612 from the playing card output receiver 606 before performing the inventory of the intermediary playing card receiver 612.

Figure 6B:
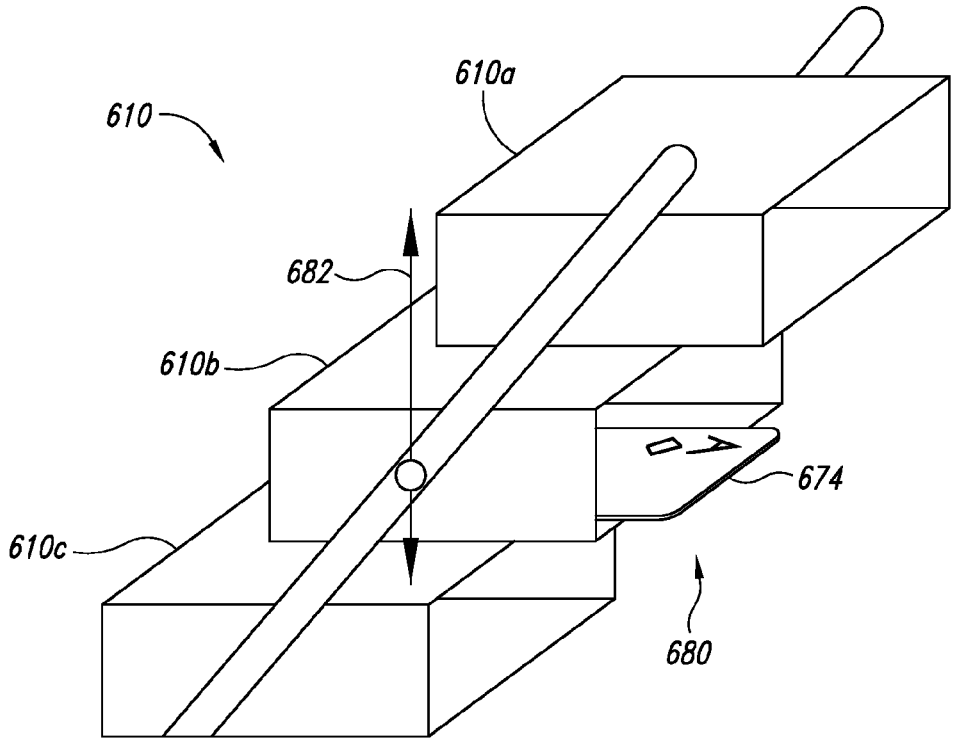
FIG. 6B is an isometric view of an intermediary playing card receiver according to an alternative illustrated embodiment, including a diagonal array of playing card receiving compartments.

FIG. 6B shows the first playing card receiver 610 according to another illustrated embodiment.

The first playing card receiver 610 includes a diagonal array 680 of playing card receiving compartments 610*a*-610*c*, which are physically coupled to move as a unit. For example, the diagonal array 680 may be mounted for bi-directional translation along a vertical axis (double headed arrow 682), which is approximately vertical with respect to the gravitational effect of the planet. Each of the playing card receiving compartments 610*a*-610*c* is sized and dimensioned to hold a plurality of playing cards 674 (only one shown).

Figure 6C:
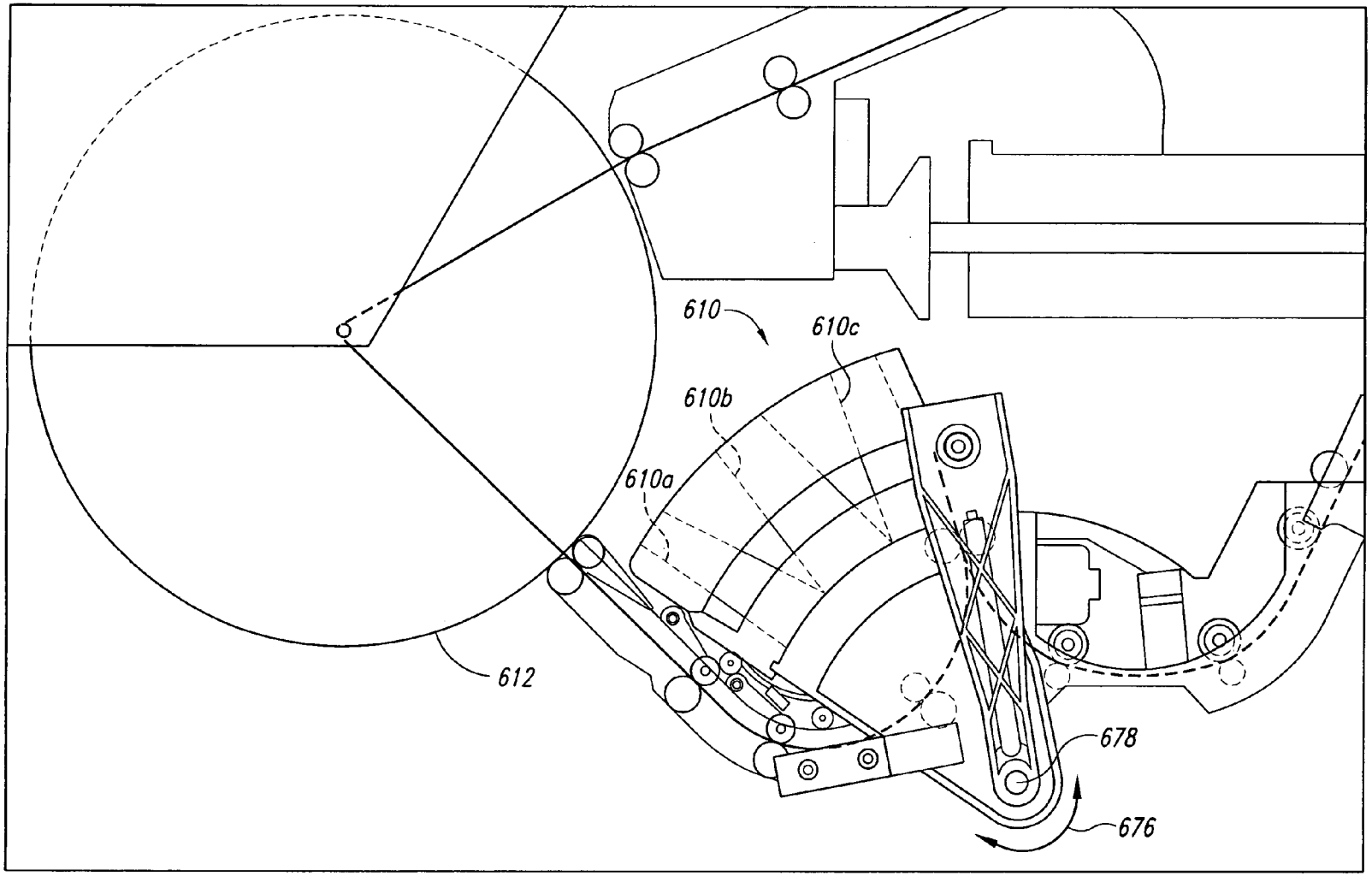
FIG. 6C is a side elevational view of an intermediary playing card receiver according to another alternative illustrated embodiment, including an array of playing card receiving compartments having an annular profile.

FIG. 6C shows the first playing card receiver 610 according to a further illustrated embodiment.

The first playing card receiver 610 includes a plurality of playing card receiving compartments 610*a*-610*c*, which are physically coupled to move as a unit. The playing card receiving compartments may be mounted for bi-directional pivotal movement (double headed arrow 676) about a horizontal axis (circle enclosing X 678), which is approximately horizontal with respect to the gravitational effect of the planet. The first playing card receiver 610 has an annular profile. Each of the playing card receiving compartments 610*a*-610*c* is sized and dimensioned to hold a plurality of playing cards (not shown).

Figure 7:
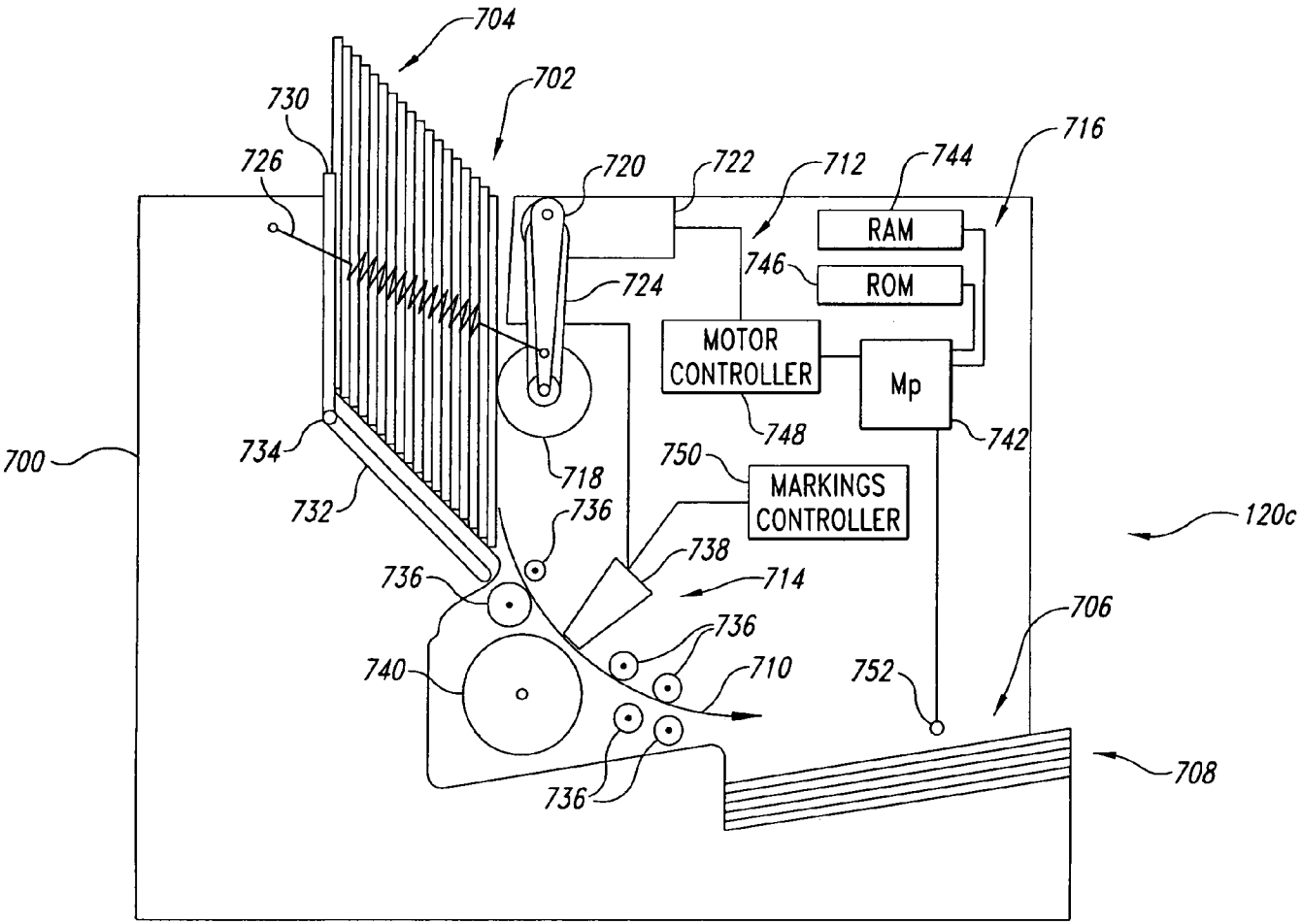
FIG. 7 is a schematic diagram of a playing card handling system according to a further illustrated embodiment.

FIG. 7 shows a playing card handling system 120*c*, according to another illustrated embodiment. As explained in detail below, the playing card handling system 120*c* is operable to provide one or more sets of randomized playing cards 718 for use in a card game, based at least in part on selected payout or house odds and/or house advantage.

The playing card handling system 120*c* includes a housing 700 having a playing card input receiver 702 for receiving playing card media 704, a playing card output receiver 706 for delivering randomized playing cards 708. A card path identified by arrow 710 extends between the playing card input receiver 702 and playing card output receiver 706. The playing card handling system 120*c* generally includes a drive mechanism 712, a markings forming mechanism 714 (e.g., print mechanism) and a control mechanism 716.

In some embodiments, the playing card media takes the form of playing card blanks without any markings. In other embodiments, the playing card media takes the form of playing card blanks with some playing card designs, but without playing card value markings (e.g., rank and/or suit symbols). Thus, the playing media may include identical ornamental designs on the backs of the playing card blanks, with the faces left blank for the playing card value markings. In still other embodiments, the playing card media may take the form of existing playing cards, from which the playing card value markings will be erased, prior to being reformed or otherwise generated. In some embodiments, the playing card media may take the form of a fiber based media, for example card stock, vellum, or polymer based media. In some embodiments, the playing card media takes the form of an active media, for example a form of electronic or "e-paper", smart paper, and/or ink code, which allows the formation and erasure of markings via electrical, magnetic, or electromagnetic radiation.

Smart paper is a product developed by Xerox Palo Alto Research Center, of Palo Alto, Calif. The smart paper consists of a flexible polymer containing millions of small balls and electronic circuitry. Each ball has a portion of a first color and a portion of a second color, each portion having an opposite charge from the other portion. Applying a charge causes the balls to rotate within the polymer structure, to display either the first or the second color. Charges can be selectively applied to form different ones or groups of the balls to from the respective markings 154-160 on the playing cards 108. The markings 154-160 remain visible until another charge is applied. Alternatively, the playing card handling system 120*c* can be adapted to employ color-changing inks such as thermochromatic inks (e.g., liquid crystal, leucodyes) which change color in response to temperature fluctuations, and photochromatic inks that respond to variations in UV light.

As illustrated in FIG. 7, the drive mechanism 712 includes a drive roller 718 rotatably mounted at the end of a pivot arm 720 and driven by a motor 722 via a drive belt 724. The motor 722 can take the form of a stepper motor, that drives the drive roller 718 in small increments or steps, such that the playing card media 704 is propelled incrementally or stepped through the card path 710 of the playing card handling system 120*c*, pausing slightly between each step. Stepper motors and their operation are well known in the art. A spring 726 biases the pivot arm 720 toward the playing card media 704 to maintain contact between the drive roller 718 and an outermost one of the playing card media 704 in the playing card input receiver 702. Thus, as the drive roller 718 rotates (counterclockwise with respect to the Figure), the outermost playing card media 704 is propelled along the card path 710. Additionally, or alternatively, a card support 730 positioned behind the playing card media 704 is supported along an inclined plane such as a guide channel 732 by one or more rollers 734. The weight of the card support 730 and or an additional attached weight (not shown) biases the card support 730 and the playing card media 704 toward the card path 710. The drive mechanism 712 also includes a number of guide rollers 736 to guide the playing card media 704 along the card path 710. Typically the guide rollers 736 are not driven, although in some embodiments one or more of the guide rollers 736 can be driven where suitable. For example, one or more guide rollers 736 may be driven where the card path 710 is longer than the length of the playing card media 704. While a particular drive mechanism 712 is illustrated, many other suitable drive mechanisms will be apparent to those skilled in the art of printing. Reference can be made to the numerous examples of drive mechanisms for both various types of printers, for example impact and non-impact printers.

The markings forming mechanism 714 may include a marking forming head 738 and a platen 740. In one embodiment, the markings forming mechanism 714 takes the form of a printing mechanism, and the marking forming head 738 take the form of a print head. The print head can take any of a variety of forms, such as a thermal print head, ink jet print head, electrostatic print head, or impact print head. The platen 740, by itself or with one or more of the guide rollers 736 (i.e., "bail rollers"), provides a flat printing surface positioned under the markings forming head 738 for the playing card media 704. While illustrated as a platen roller 740, the playing card handling system 120*c* can alternatively employ a stationary platen diametrically opposed from the markings forming head 738, where suitable for the particular playing card media 704. In an alternative embodiment, the platen roller 740 may be driven by the motor 722, or by a separate motor. In other embodiments, marking forming head 738 may take the form of a magnetic write head, similar to those employed to encode information into magnetic stripes. In other embodiments, marking forming head 738 may take the form of an inductive write head, an radio frequency transmitter, or transmitter of other frequencies of electromagnetic radiation, including but not limited to optical magnetic radiation (e.g., visible light, ultraviolet light, and/or infrared light).

The control mechanism 716 includes a microprocessor 742, volatile memory such as a Random Access Memory ("RAM") 744, and a persistent memory such as a Read Only Memory ("ROM") 746. The microprocessor 742 executes instructions stored in RAM 744, ROM 746 and/or the microprocessor's 742 own onboard registers (not shown) for generating a random playing card sequence, and printing the appropriate markings on the playing cards in the order of the random playing card sequence. The control mechanism 716 also includes a motor controller 748 for controlling the motor 712 in response to motor control signals from the microprocessor 742, and a markings controller 750 for controlling the marking forming head 738 in response to marking forming control signals from the microprocessor 742.

The control mechanism 716 may further include a card level detector 752 for detecting a level or number of playing cards in the playing card output receiver 706. The card level detector 752 can include a light source and receiver pair and a reflector spaced across the playing card holder from the light source and receiver pair. Thus, when the level of playing cards 708 in the playing card output receiver 706 drops below the path of the light, the card level detector 752 detects light reflected by the reflector, and provides a signal to the microprocessor 742 indicating that additional playing cards 708 should be formed (e.g., printed or otherwise encoded). The playing card handling system 120*c* can employ other level detectors, such as mechanical detectors.

In operation the microprocessor 742 executes instructions stored in the RAM 744, ROM 746 and/or microprocessor's registers to computationally randomly generate virtual playing card values from a domain of playing card values, based at least in part on the selected payout or house odds and/or house advantage.

The microprocessor 742 generates markings forming data based on the computationally generated virtual playing card values. The markings forming data consists of instructions for forming playing card value markings, and optionally non-value markings, on respective ones of the playing card media 704 that correspond to respective virtual playing card values from the random playing card sequence. For example, the markings forming data can identify which elements of the markings forming head 738 to activate at each step of the motor 722 to form a desired image. During each pause between steps of the motor 722, a small portion of one of the playing card media 704 is aligned with the markings forming head 738 and selected elements of the markings forming head 738 are activated to produce a portion of an image on the portion of the playing card media 704 aligned with the markings forming head 738. The image portion is a small portion of an entire image to be formed. The entire image typically is produced by stepping the card blank 704 past the markings forming head 738, pausing the playing card media 704 after each step, determining the portion of the image corresponding to the step number, determining which elements of the markings forming head 738 to activate to produce the determined portion of the image, and activating the determined elements to produce the determined portion of the image on the playing card media 704. The microprocessor 742 provides the markings forming data as motor commands to the motor controller 748 and as markings forming commands to the markings forming controller 750, for respectively synchronizing and controlling the motor 722 and markings forming head 738. The markings may take a non-visible form, and/or may take the form of magnetically detectable markings, for example magnetic orientations in a magnetic stripe.

Thus, the playing card handling system 120*c* of FIG. 7 provides a standalone card distribution device for providing playing cards in a pseudo-random fashion based at least in part on the selected payout or house odds and/or house advantage, which may be used at any gaming position. Since the playing card handling system 120*c* includes a microprocessor 742 which may implement the RNG function, the playing card handling system 120*c* is particularly suited for the manually monitored gaming table 18 of FIG. 2, where the playing card handling system 120*c* operates in a standalone mode. However, the playing card handling system 120*c* can operate as an integral portion of the automated table game system, or in conjunction with such a system.

In another embodiment, the playing card handling system 120*c* may include at least one playing card reading sensor positioned between the playing card input receiver and the playing card output receiver, identical or similar to that of the previously discussed embodiments. Additionally, or alternatively, the playing card handling system 120*c* may include an erase mechanism (not shown) positioned between the playing card input receiver and the print mechanism. The erase mechanism is operable to erase marking from previously used playing cards. Erasing may include removing previously printed markings physically, chemically and/or via electromagnetic radiation. Alternatively, erasing may include electrically, inductively, or magnetically removing previously encoded markings, for example where the playing card characters or symbols were formed using smart or electronic paper media, ink code or other active media.

Brief Overview of the Operation of Playing Card Handling Systems

Each of the playing card handling systems 120*a*, 102*b*, 120*c* (collectively 120) provide randomized playing cards 518, 618, 718 at the playing card output receiver 506, 606, 706, respectively, based at least in part on a selected set of payout or house odds and/or house advantage.

In various embodiments, the randomized playing cards 518, 618, 718 may be delivered individually (e.g., one at a time), as multiple subsets (e.g., individual hands), or as one set (e.g., multiple hands). Such variations are discussed immediately below.

Figure 8:
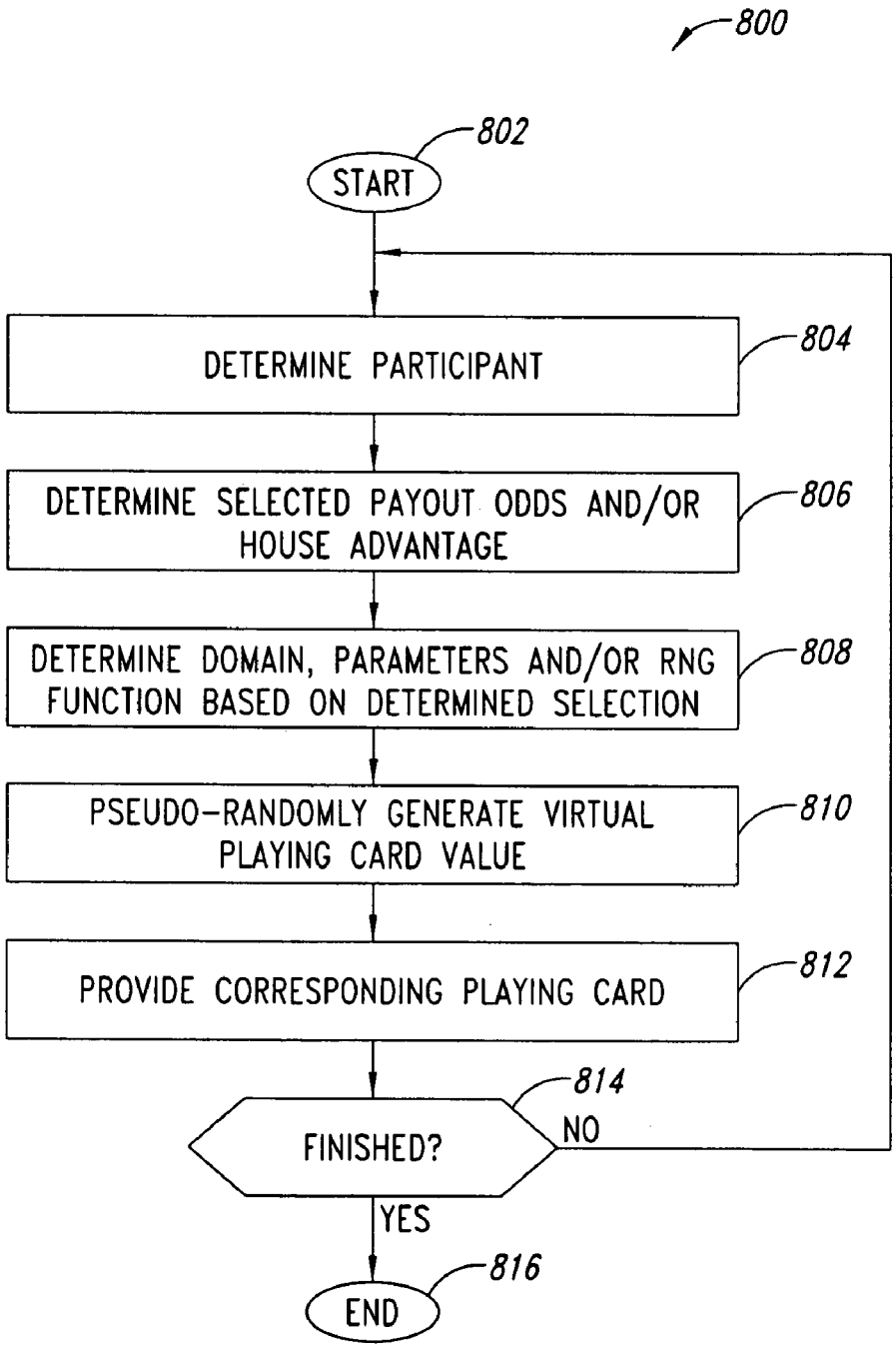
FIG. 8 is a flow diagram of a method of operating a playing card handling system such as that illustrated in FIGS. 5A, 5B, 6A, and 7 according to one illustrated embodiment, to provide playing cards one at a time.

For example, the randomized playing cards 518, 618, 718 may be delivered to the output playing card receiver one at a time, as illustrated in FIG. 8. Thus, a playing card may be selected or generated that corresponds to a virtual playing card value that has been randomly generated based on the payout or house odds and/or house advantage selected for the particular player position 104 (FIGS. 1 and 2) to which the playing card will be dealt.

This approach advantageously requires little computational overhead with respect to positioning or interleaving the playing cards for various participant positions (e.g., player positions 104 and dealer position 106) with respect to one another in a set or stack of playing cards.

In particular, a method 800 of delivering playing cards one at a time starts at 802. At 804, the playing card handling system 120 determines a participant 110, 114 (FIGS. 1 and 2) or participant position 104, 106 to which the playing card will be dealt. Such may be based on the rules of the game and/or on information received from the players 110, the dealer 114, or various other gaming systems 404 (FIG. 4).

At 806, the playing card handling system 120 determines the selected payout or house odds and/or house advantage for the participant 110, 114 or participant position 104, 106. Such is based on the selection received by the playing card handling system 120.

At 808, the playing card handling system 120 determines a domain of playing card values, parameters for a Random Number Generator (RNG) function and/or a particular RNG function, for pseudo-randomly generating virtual playing card values. The playing card handling system 120 may determine a total number of playing card values composing the domain to achieve or partially achieve particular payout or house odds and/or house advantage. Alternatively, or additionally, the playing card handling system 120 may select the playing card values composing the domain to achieve or partially achieve particular payout or house odds and/or house advantage. For example, the playing card handling system 120 may omit certain playing card values (e.g., those corresponding to one or more Aces), or may over represent certain playing card values (e.g., fives). Such may be used to control the probability of a bonus hand occurring (e.g., five Queen of hearts in a single hand), for which a bonus or progressive payout is made. Alternatively, or additionally, the playing card handling system 120 may select parameters that weight the RNG function to increase and/or decrease the probability of generating certain virtual playing card values. For example, the playing card handling system 120 may select parameters that increase, or alternatively, decrease the probability of generating a virtual playing card value corresponding to playing cards having a value of ten (e.g., tens and face cards). Alternatively, or additionally, the playing card handling system 120 may select between a plurality of RNG functions, each designed to produce on average a respective payout or house odds and/or house advantage.

At 810, the playing card handling system 120 pseudo-randomly generates a virtual playing card value using the determined domain, parameters and/or RNG function. At 812, the playing card handling system 120 provides a playing card corresponding to the pseudo-randomly generated virtual playing card value. At 814, the playing card handling system 120 determines whether there are additional playing card to be dealt. If so, control returns to 804, otherwise the method 800 terminates at 816.

Figure 9:
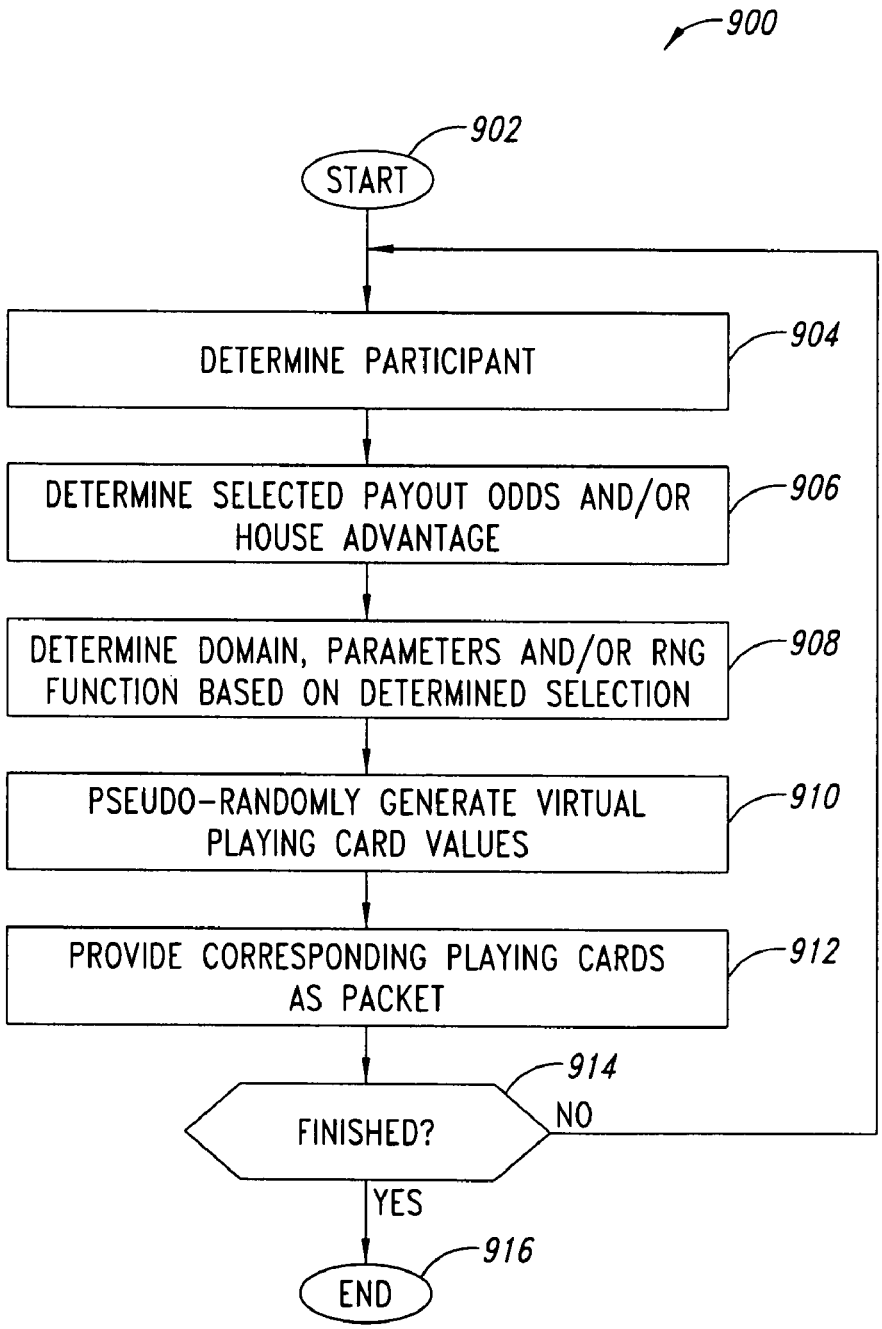
FIG. 9 is a flow diagram of a method of operating a playing card handling system such as that illustrated in FIGS. 5A, 5B, 6A and 7, according to one illustrated embodiment, to provide playing cards in subsets or packets.

Also for example, the randomized playing cards 518, 618, 718 may be delivered to the output playing card receiver 506, 606, 706 as subsets or packets of playing cards, as illustrated in FIG. 9. For example, each subset of playing cards may form a hand of playing cards intended for a respective one of the participant positions (e.g., player positions 104 and dealer position 106). Thus, playing cards may be selected or generated that correspond to a number of virtual playing card values that have been randomly generated based on the payout odds or house advantage selected for the particular player position 104 (FIGS. 1 and 2) to which the subset or packet of playing cards will be dealt. In such embodiments, it may be advantageous for the playing card output receiver 506, 606, 706, to have multiple card receiving compartments.

This approach may be particularly suitable for card games that deal complete hands to players at the start of the game. This approach may be particularly suitable for card games that deal partial hands to players 110 at the start of the game, and which employ later dealt common cards that are shared by the various participants 110, 114 to complete the participant's respective hands.

This approach again advantageously requires little computational overhead with respect to positioning or interleaving the playing cards for various participant positions (e.g., player positions 104 and dealer position 106) with respect to one another in a set or stack of playing cards. However, to the extent that participants 110, 114 share common cards, such will need to be taken into account in determining the actual payout odds and/or house advantage since these later dealt cards must correspond to a common probability. This will increase the computational complexity to some degree, over the immediately preceding embodiment.

In particular, a method 900 of delivering playing cards as subsets or packets of playing cards starts at 902. At 904, the playing card handling system 120 determines a participant 110, 114 (FIGS. 1 and 2) or participant position 104, 106 to which the playing card will be dealt. Such may be based on the rules of the game and/or on information received from the players 110, the dealer 114, or various other gaming systems 404 (FIG. 4).

At 906, the playing card handling system 120 determines the selected payout or house odds and/or house advantage for the participant 110, 114 or participant position 104, 106. Such determination is based on the selection received by the playing card handling system 120.

At 908, the playing card handling system 120 determines a domain of playing card values, parameters for an RNG function and/or a particular RNG function for pseudo-randomly generating virtual playing card values. The playing card handling system 120 may determine the domain, parameters, and/or a particular RNG function in the same or similar fashion as discussed above in reference to FIG. 8. Such operation is not repeated in the interest of brevity.

At 910, the playing card handling system 120 pseudo-randomly generates virtual playing card values using the determined domain, parameters and/or RNG function. At 912, the playing card handling system 120 provides playing cards corresponding to the pseudo-randomly generated virtual playing card values as a packet or subset. At 914, the playing card handling system 120 determines whether there are additional playing card to be dealt. If so, control returns to 904, otherwise the method 900 terminates at 916.

Figure 10:
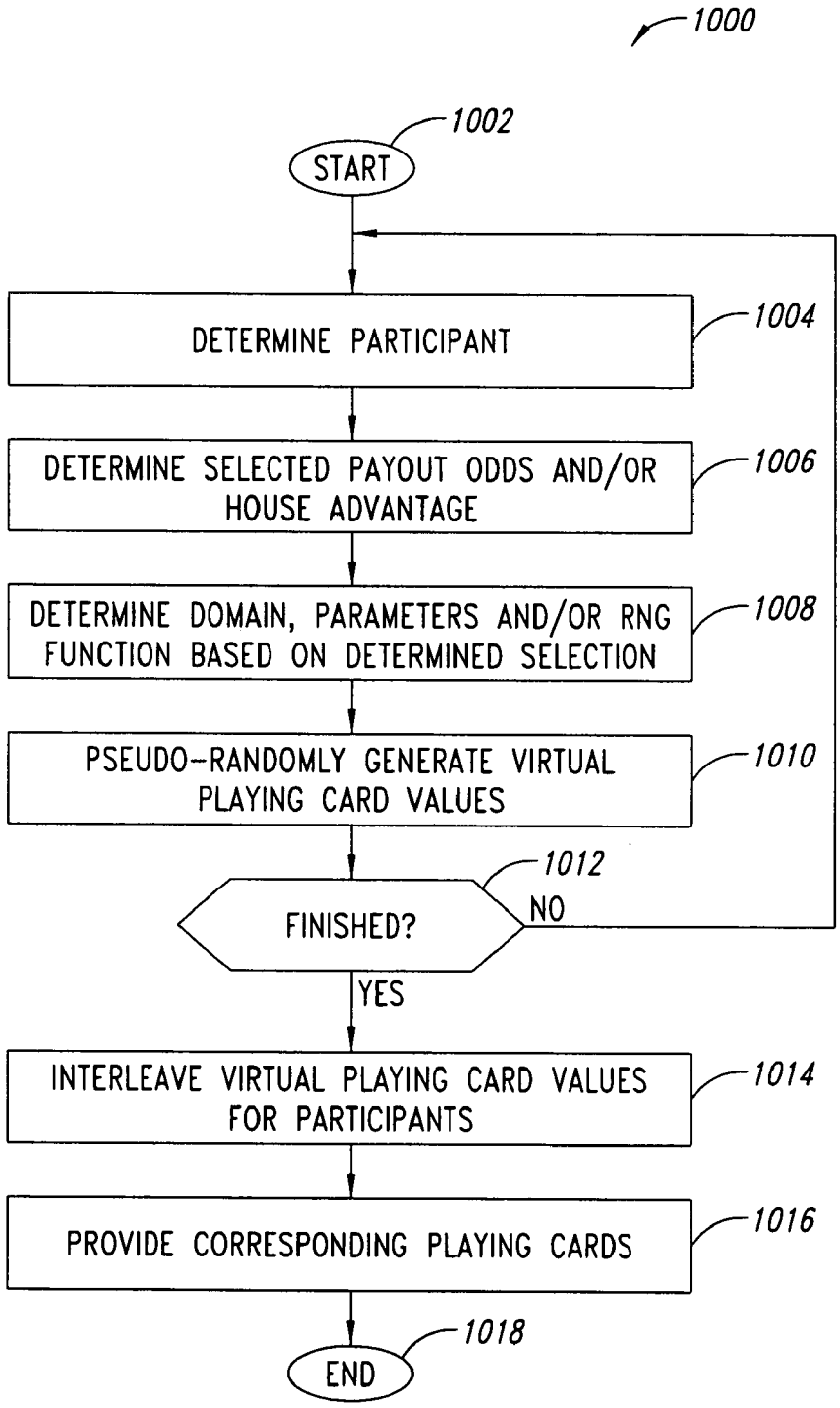
FIG. 10 is a flow diagram of a method of operating a playing card handling system such as that illustrated in FIGS. 5A, 5B and 6A, according to one illustrated embodiment, to provide playing cards as a set of interleaved or intermingled playing cards.
Figure 11:
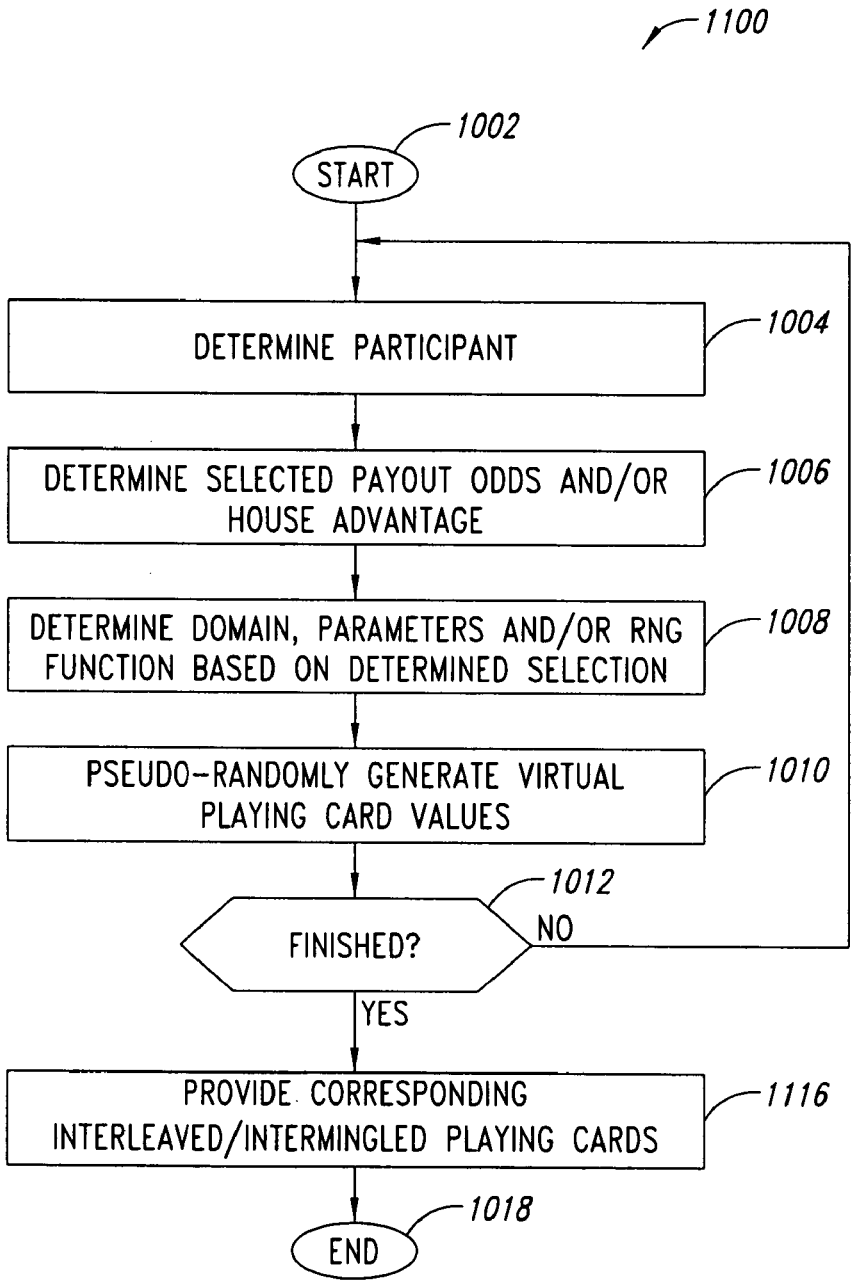
FIG. 11 is a flow diagram of a method of operating a playing card handling system such as that illustrated in FIGS. 5A, 5B and 6A, according to one illustrated embodiment, to provide playing cards as a set of interleaved or intermingled playing cards.

As a further example, the randomized playing cards 518, 618, 718 may be delivered to the output playing card receiver 506, 606 706 as a set for dealing multiple hands of playing cards to various participant positions (e.g., player positions 104 and dealer position 106), as illustrated in FIG. 10. Thus, playing cards may be selected or generated that correspond to a number of subsets of virtual playing card values that have been randomly generated based on the payout or house odds and/or house advantage selected for the particular player position 104 (FIGS. 1 and 2) to which the playing cards will be dealt. Alternatively, a number of subsets of virtual playing card values may be randomly generated based on the payout or house odds and/or house advantage selected for the particular player position 104 (FIGS. 1 and 2), the virtual playing card values of the subsets may be positioned or interleaved with one another based on the relative order of the participant positions 104, 106 to form a set of virtual playing card values, and then the playing cards corresponding to the set of virtual playing card values may be selected or generated.

This approach may be particularly suitable for card games that deal complete hands to players at the start of the game. This approach may be suitable for card games that deal partial hands to players at the start of the game, and which employ later dealt common cards that are shared by the various participants 110, 114 to complete the participant's respective hands. This approach may be particularly suitable for card games where the rules dictate the number of playing cards that will be selected by, or dealt to, each participant position. For example, the rules of baccarat dictate when each of the participants (e.g., player and bank) must take additional playing cards (e.g., hit cards). This approach may advantageously simplify the dealing of playing cards to the various participants 110, 114. However, this approach may require extra computational overhead with respect to positioning or interleaving the playing cards for various participant positions (e.g., player positions 104 and dealer position 106) with respect to one another in a set or stack of playing cards as compared to the two most immediately described approaches. In games where participants share common cards, such will need to be taken into account in determining the actual payout or house odds and/or house advantage since these later dealt cards must correspond to a common probability. As discussed above, this will increase the computational complexity to some degree.

In particular, a method 1000 of delivering a set of playing cards for dealing multiple hands of playing cards to various participant positions 104, 106 (FIGS. 1 and 2) starts at 1002. At 1004, the playing card handling system 120 determines a participant 110, 114 (FIGS. 1 and 2) or participant position 104, 106 to which the playing card will be dealt. Such may be based on the rules of the game and/or on information received from the players 110, the dealer 114, or various other gaming systems 404 (FIG. 4).

At 1006, the playing card handling system 120 determines the selected payout or house odds and/or house advantage for the participant 110, 114 or participant position 104, 106. Such determination is based on the selection received by the playing card handling system 120.

At 1008, the playing card handling system 120 determines a domain of playing card values, parameters for an RNG function and/or a particular RNG function for pseudo-randomly generating virtual playing card values. The playing card handling system 120 may determines the domain, parameters, and/or a particular RNG function in the same or similar fashion as discussed above in reference to FIG. 8. Such operation is not be repeated in the interest of brevity.

At 1010, the playing card handling system 120 pseudo-randomly generates virtual playing card values using the determined domain, parameters and/or RNG function. At 1012, the playing card handling system 120 determines whether there are additional participants 110, 114 to process. If so, control returns to 1004 to determine the next participant 110, 114, otherwise the method 900 passes control to 1014.

At 1014, the playing card handling system 120 interleaves the virtual playing card values of the various participants 110, 114. The playing card handling system 120 may advantageously employ information regarding the relative position in an order of dealing of the various participant positions 104, 106 with respect to one another. At 1016, the playing card handling system 120 provides playing cards corresponding to the pseudo-randomly generated virtual playing card values as a set of interleaved or intermingled subsets. The method 1000 terminates at 1018.

Also in particular, a method 1100 of delivering a set of playing cards for dealing multiple hands of playing cards to various participant positions 104, 106 (FIGS. 1 and 2) employs many of the same or similar acts as the method 1000. Such acts are denominated with the same references numbers. Only significant differences are discussed below.

Instead of interleaving or intermingling the virtual playing card values, the playing card handling system 120 physically interleaves or intermingles the actual playing cards at 1116 in method 1110. Such may be done by selectively inserting playing cards into the intermediary playing card receivers 510, 512, 610, 612. Such may alternatively be done by selectively removing playing cards into the intermediary playing card receivers 510, 512, 610, 612.

Figure 12:
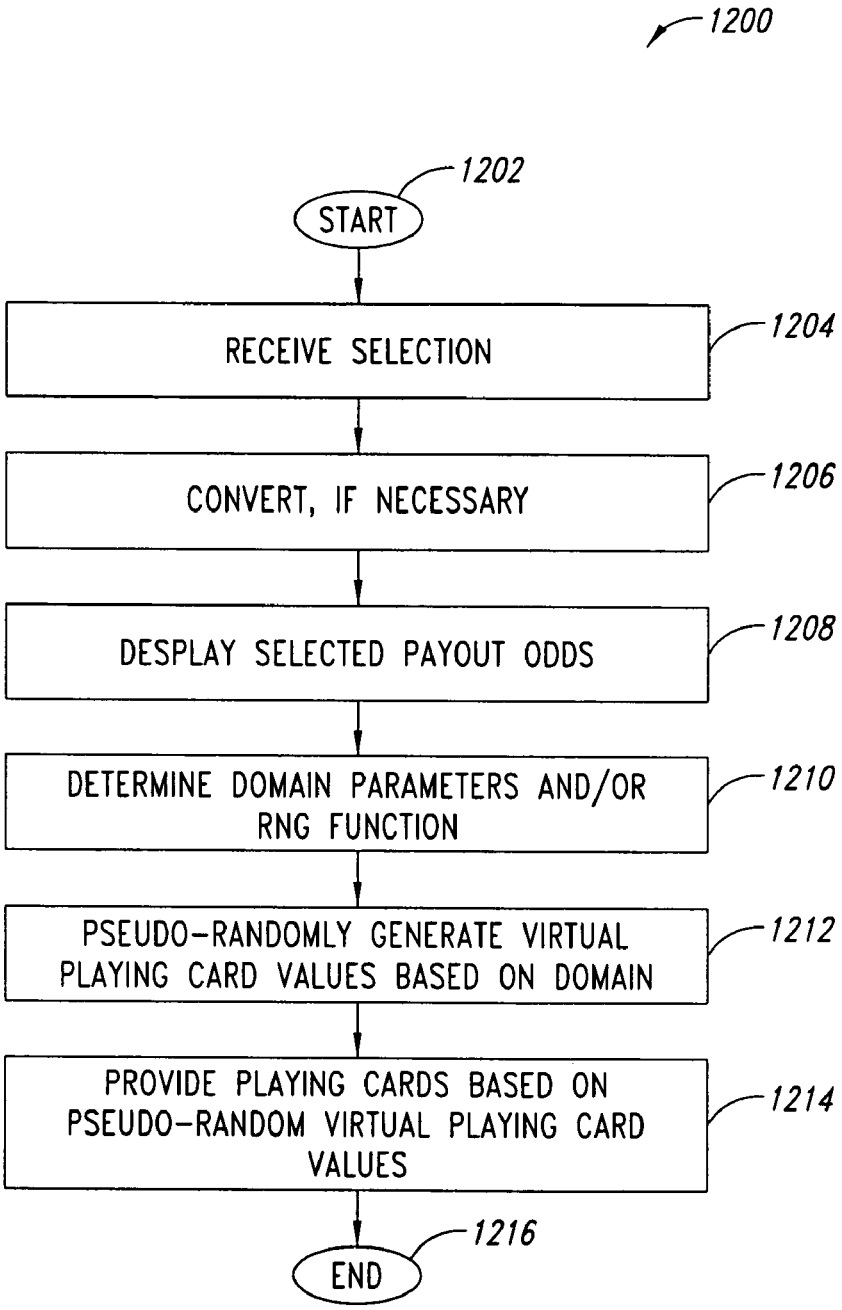
FIG. 12 is a flow diagram of a method of operating a gaming environment to allow selection and display of theoretical and/or payout odds, according to one illustrated embodiment.

FIG. 12 shows a method 1200 of operating a gaming environment according to one illustrated embodiment, starting at 1202.

At 1204, the host computing system 124 (FIGS. 1-4) and/or playing card handling system 120 receives selection from a player 110 or dealer 114 indicative of a set of payout or house odds and/or house advantage. At 1204, the host computing system 124 and/or playing card handling system 120 converts the received, if necessary. For example, the host computing system 124 and/or playing card handling system 120 may convert player defined payout or house odds to an acceptable value, for example an pair of integer values, and/or may convert payout or house odds to a house advantage. At 1208, the host computing system 124 and/or playing card handling system 120 causes one or more displays 126 to display the payout or house odds and/or house advantage to at least one of the participants 110, 114.

At 1210, the host computing system 124 and/or playing card handling system 120 determines a domain, parameters and/or RGN function based on the payout or house odds and/or house advantage. The host computing system 124 and/or playing card handling system 120 may, for example, employ a mathematical function, algorithm or lookup table.

The randomization of playing cards employs an RNG function to produce random virtual playing card values, based at least in part on the selected payout or house odds and/or house advantage. Performance of RNG on computers is well known in the computing arts. Mathematicians do not generally consider computer generated random numbers to be truly random, and thus commonly refer to such numbers as being pseudo-random. However such numbers are sufficiently random for most practical purposes, such as distributing playing cards to players. Hence, while we typically denominate the computer generated values as being random and the playing cards as being randomized, such terms as used herein and in the claims encompasses pseudo-random numbers and ordering, and includes any values or ordering having a suitable random distribution or probability of occurrence based on a selected set of odds or probabilities, whether truly mathematically random or not.

In some embodiments, the virtual playing card values may be computationally generated (e.g., via an RNG algorithm) executed by a suitable controller. In some embodiments, the virtual playing card values may be determined from predefined data that is randomly selected, such as from one or more lookup tables. For example, the virtual playing card values may comprise a sorted order, such as the order of playing cards in a new deck, prior to shuffling.

In order to reflect the selected payout or house odds and/or house advantage, the playing card handling system 120 may select or form a suitable domain of playing card values on which the RNG will operate. Thus, for example, the playing card handling system 120 may select or adjust the size of the domain, and/or the composition of the domain of playing card values before or while executing the RNG algorithm. Additionally, or alternatively, in order to reflect the selected payout or house odds and/or house advantage, the playing card handling system 120 may select suitable parameters for the RNG algorithm from a number of parameters, the parameters weighting or biasing the RNG algorithm towards or away from generating certain virtual playing card values. Additionally, or alternatively, in order to reflect the selected payout or house odds and/or house advantage, the playing card handling system 120 may select a suitable RNG algorithm from a number of RNG algorithms, the RNG algorithms weighted or biased towards or away from generating certain virtual playing card values.

As discussed above, the virtual playing card values may be generated one at a time, for example on an as needed basis. Alternatively, the virtual playing card values may be generated as subsets, or sets formed of two or more subsets. The particular approach may depend on the rules of the card game and whether playing cards will be dealt individual in groups such as packets.

The virtual playing card values may take a variety of forms. The virtual playing card values may take the form of electronic or other data that represent or are otherwise indicative of a playing card value (e.g., rank) or identity (e.g., rank and suit). The electronic data may, for example, take the form of an ordered list of virtual playing card values. The virtual playing card values may be generated from a domain of playing card values. The domain may include playing card values representative of respective ones of the playing cards in a standard, fifty-two (52) card deck. For example, the domain of playing card values consist of the integers 0-51, each associated with a respective rank and suit combination. Alternatively, the domain of playing card values may, for example, take the form of two integers, a first integer representing a rank (e.g., 0-12) and a second integer representing a suit (e.g., 0-13).

The domain of playing card values may comprise a fewer or greater number of playing cards than the number of playing cards in a standard, fifty-two (52) card deck. For example, the domain of playing card values may take the form of set of identifiers (e.g. serial) numbers that are each uniquely associated with a playing card from a set of playing cards greater than a standard deck of 52 playing cards. Thus, there may be two or more playing cards of the same rank and suit, each of which is identified by a unique identifier in the domain of playing card values. Alternatively, the domain may include fewer than an integer multiple of a standard fifty-two playing card deck.

Additionally or alternatively, the virtual sequence 120 may be determined from predefined data such as one or more lookup tables, for example a sorted order that corresponds to the order of cards, un-shuffled, from a new playing deck.

At 1212, the provides one or more playing cards based on one or more pseudo-randomly generated virtual play card values. The method 1200 may terminate at 1216, until the occurrence of another trigger event, or may continually repeat as a loop.

Detailed Discussion of Operation of Various Playing Card Handling Systems

The specific operation of the various playing card handling systems 120 to provide the randomized playing cards 518, 618, 718 is discussed in detail below.

Figure 13:
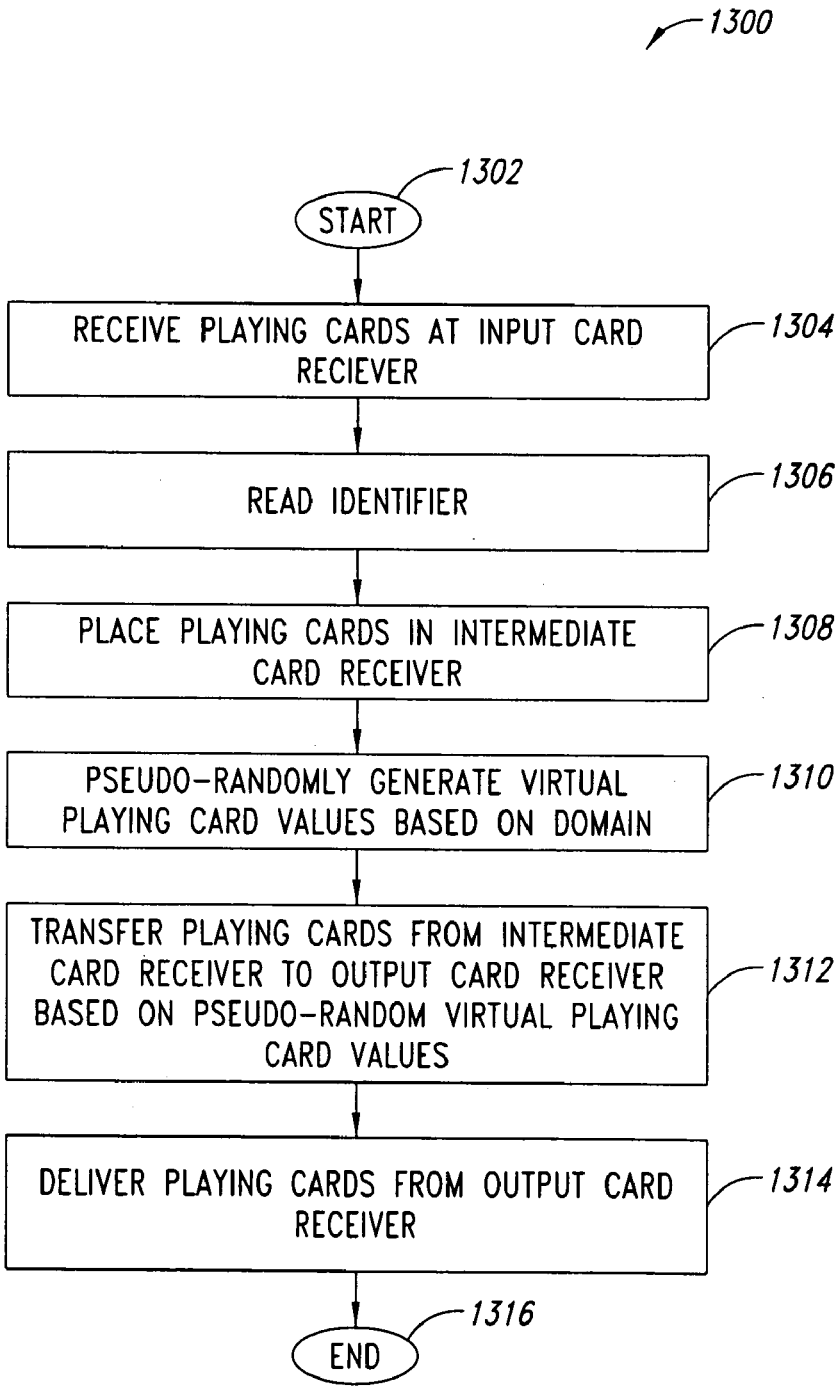
FIG. 13 is a flow diagram of a method of operating a playing card handling system such as that illustrated in FIGS. 5A, 5B and 6A, according to one illustrated embodiment.

FIG. 13 shows a method 1300 of operating one of the playing card handling systems 120*a*, 120*b*, according to one illustrated embodiment starting at 1302.

At 1304, the playing card handling system 120*a*, 120*b* (FIGS. 5A, 5*b*, 6A) receives collected playing cards 515, 616 at the playing card input receiver 504, 604. At 1306, the playing card reading sensor 513, 613 reads identifying information from the playing cards. At 1308, the playing card handling system 120*a*, 120*b* places the playing cards in one or more of the intermediary playing card receivers 510, 512, 610, 612. The playing card handling system 120*a*, 120*b* may advantageously place each playing card in a closest empty card receiving compartment of the intermediary playing card receiver 510, 512, 610, 612. The most immediate empty card receiving compartment may be the card receiving compartment that is nearest the playing card transport path based on movement of the intermediary playing card receiver 510, 512, 610, 612 in either of two directions of movement (e.g., clockwise/counterclockwise, or up/down). This advantageously reduces the time to load the intermediary playing card receivers 510, 512, 610, 612. The playing card handling system 120*a*, 120*b* keeps track of the identity of the playing cards in the respective card receiving compartments.

At 1310, the playing card handling system 120*a*, 120*b* randomly or pseudo-randomly generates one or more virtual playing card values based on a domain, parameters, and/or RNG function. Such has been discussed in detail above.

At 1312, the playing card handling system 120*a*, 120*b* transfers playing cards from the intermediary playing card receiver 510, 512, 610, 612 to the output card receiver 506, 606, based on the random or pseudo-random virtual playing card values. Thus, the playing card handling system 120*a*, 120*b* may advantageously select and/or otherwise remove playing cards from the intermediary playing card receivers 510, 512, 610, 612 in a random order.

At 1314, the playing card handling system 120*a*, 120*b* delivers the playing cards from the output card receiver 506, 606. The method 1300 terminates at 1316.

Figure 14:
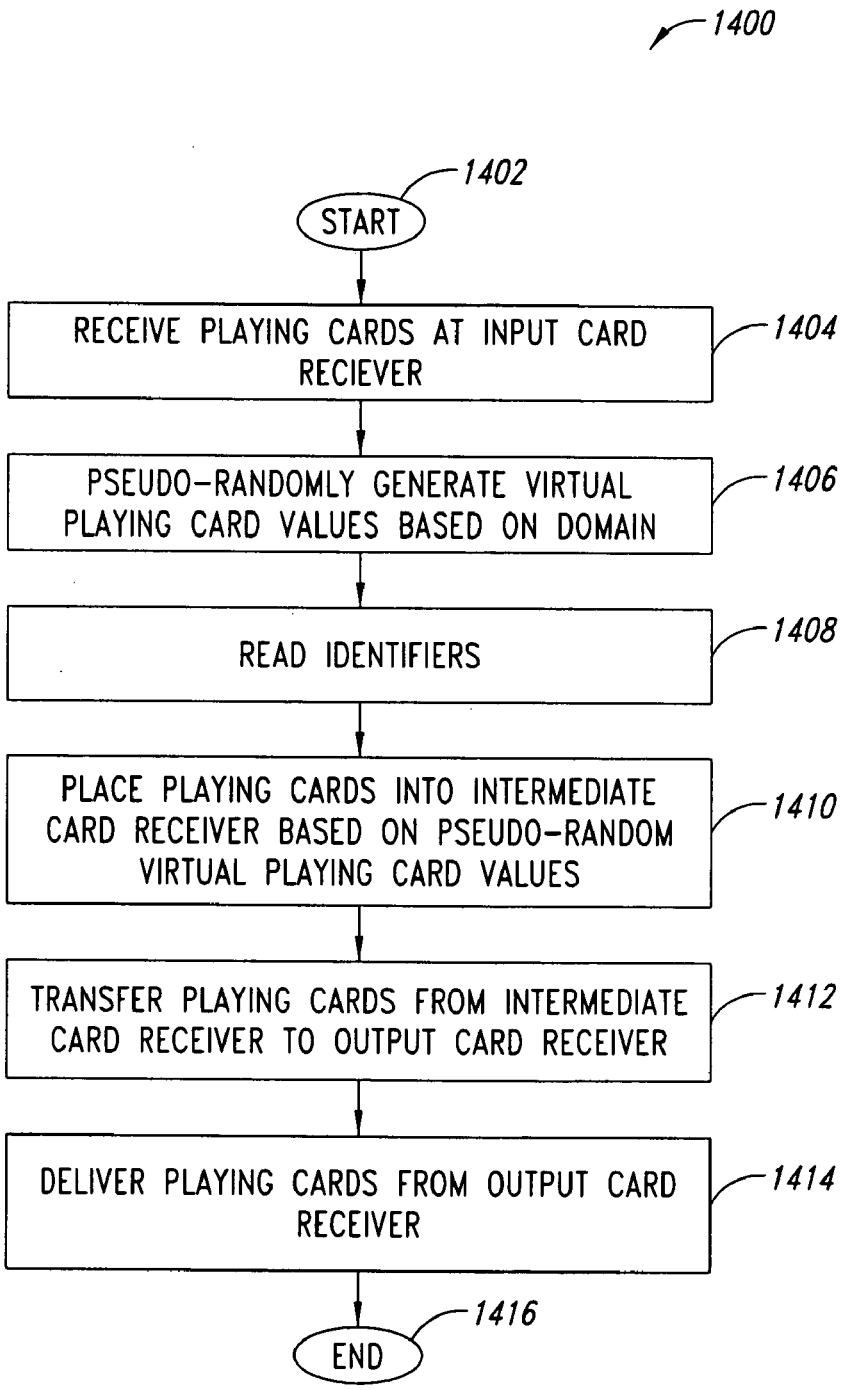
FIG. 14 is a flow diagram of a method of operating a playing card handling system such as that of FIGS. 5A, 5B and 6A, according to one illustrated embodiment.

FIG. 14 shows a method 1400 of operating a playing card handling system 120*a*, 120*b* according to another illustrated embodiment, starting at 1402.

At 1404, the playing card handling system 120*a*, 120*b* receives collected playing cards 515, 616 at the playing card input receiver 504, 604. At 1406, the playing card handling system 120*a*, 120*b* randomly or pseudo-randomly generates virtual playing card values based on a domain, parameters, and or RNG function. Such has been described in detail above and will not be repeated in the interest of brevity. At 1408, the playing card reading sensor 513, 613 reads identifiers from the playing cards.

At 1410, the playing card handling system 120*a*, 120*b* places playing cards into one or more of the intermediary playing card receivers 510, 512, 610, 612 based at least in part on the random or pseudo-random virtual playing card values. The playing card handling system 120*a*, 120*b* keeps track of the identity of the playing cards in the respective card receiving compartments. At 1412, the playing card handling system 120*a*, 120*b* transfers playing cards from the intermediary playing card receiver 510, 512, 610, 612 to the output card receiver 506, 606. At 1414, the playing card handling system 120*a*, 120*b* delivers playing cards from the output card receiver 506, 606. The method 1400 terminates at 1416.

Figure 15:
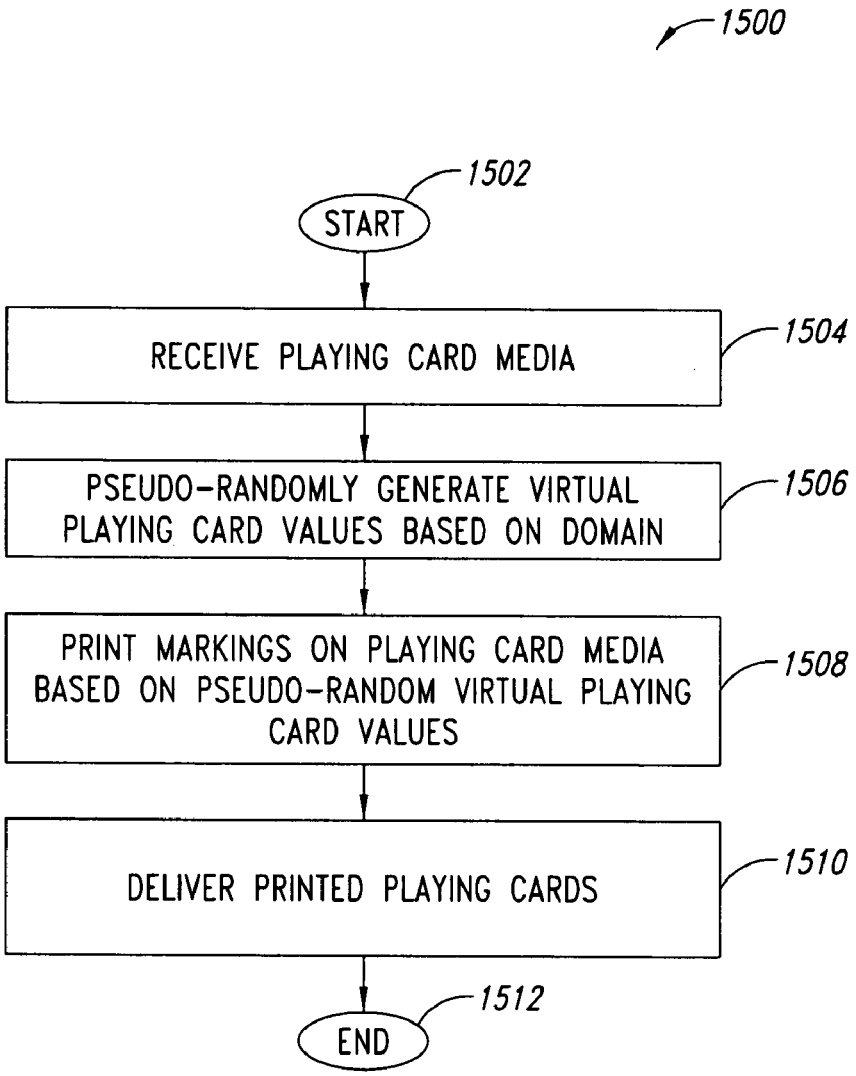
FIG. 15 is a flow diagram of a method of operating a playing card handling system such as that of FIG. 7, according to one illustrated embodiment.

FIG. 15 shows a method 1500 of operating a playing card handling system 120*c* (FIG. 7), according to one illustrated embodiment.

The method 1500 starts at 1502, for example, in response to activation of a switch by a user, detection of playing card media 702 at the playing card media input receiver 704 or detection of a lack of playing cards at the playing card output receiver 706. At 1504, the playing card handling system 120*c* receives playing card media 702 at a playing card input receiver 704. At 1506, the playing card handling system 120*c* randomly or pseudo-randomly generates virtual playing card values based on a domain, parameters, and/or RNG function. The determination or selection of the domain, parameters, and/or RNG function is discussed above and is not repeated here in the interest of brevity.

At 1508, the playing card handling system 120*c* forms markings on the playing card media based on the random or pseudo-random virtual playing card values. The markings may take the form of one or more markings indicative of a playing card value (e.g., rank, suit, and/or point value). The markings may include additional indicia, for example, pips, traditional indicia such as drawings of jacks, queens, kings, ornamental designs, or nontraditional value markings.

At 1510, the playing card handling system 120*c* delivers playing cards at the playing card output receiver 706. The method 1500 terminates at 1512.

Figure 16:
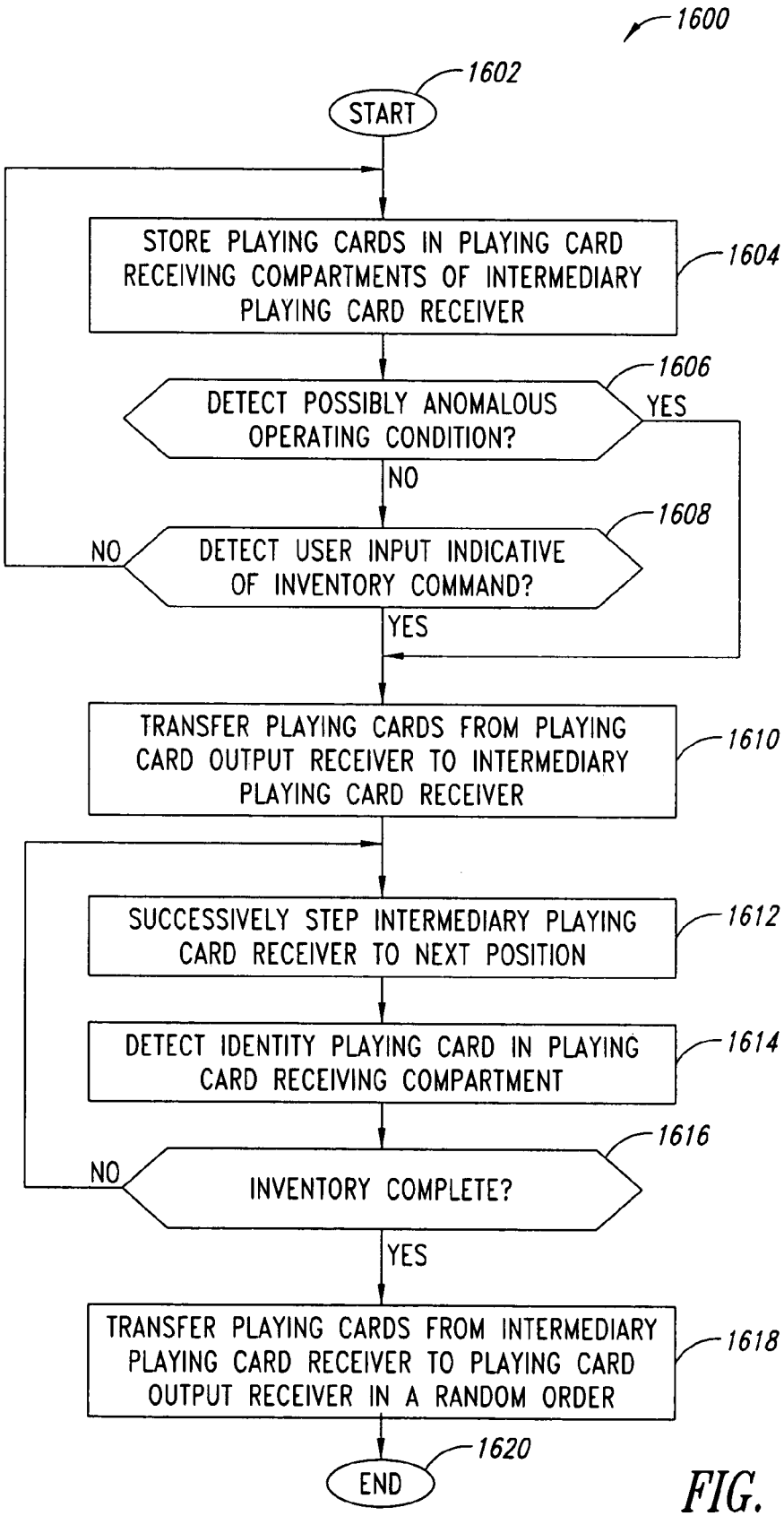
FIG. 16 is a flow diagram showing method of operating a playing card handling system such as that of FIGS. 5A, 5B and 6, to inventory an intermediary playing card receiver, according to one illustrated embodiment.

FIG. 16 shows method 1600 of operating a playing card handling system such as that of FIGS. 5A, 5B and 6, to inventory an intermediary playing card receiver, according to one illustrated embodiment, starting at 1602.

At 1604, the playing card handing system 120*a*, 120*b* stores playing cards in the playing card receiving compartments 510*a*-510*c*, 512*a*-512*c*; 612*a*-612*c* of the intermediary playing card receiver 510, 512, 612 during normal operation as described above.

At 1606, the playing card handing system 120*a*, 120*b* determines whether a possibly anomalous operation or operating condition has been detected. For example, an unexpected playing card may be detected in one of the playing card receiving compartments 510*a*-510*c*, 512*a*-512*c*; 612*a*-612*c*, or a power loss or interrupt may be detected. If a possibly anomalous operation or operating condition is not detected control passes to 1608, and if a possibly anomalous operation or operating condition is detected control passes to 1612 or optionally 1610.

At 1608, the playing card handing system 120*a*, 120*b* determines whether a user input corresponding to a command to perform an inventory has been detected. This permits users to inventory playing cards, either in regular course of operation or in response to the occurrence of some suspect act or condition at the gaming table 102. If the user input is not detected, control returns to 1604, and if a user input is detected control passes to 1612 or optionally 1610.

Optionally at 1610, the playing card handing system 120*a*, 120*b* transfers playing cards from playing card output receiver 506. 606 to the intermediary playing card receiver 510, 512, 610, 612. This permits the portion of the randomly ordered playing cards at the playing card output receiver 506, 606 to be replaced into the intermediary playing card receiver 510, 512, 610, 612, and reused to form a new set of randomized playing cards. Such may advantageously reduce the time required to produce the new set of randomized playing cards and/or may make such operation transparent to those at the gaming table 102.

At 1612, the playing card handing system 120*a*, 120*b* successively steps the intermediary playing card receiver to a next position. Thus, the playing card handing system 120*a*, 120*b* may align one or more of the playing card receiving compartments 510*a*-510*c*, 512*a*-512*c*; 612*a*-612*c* with the inventory card sensor 570*a*, 570*b*, 670. This may be particularly advantageous where the inventory card sensor 570*a*, 570*b*, 670 is a line-of-sight device or has a limited range.

At 1614, the playing card handing system 120*a*, 120*b* detects an identity of a playing card In the playing card receiving compartment 510*a*-510*c*, 512*a*-512*c*; 612*a*-612*c*. As discussed above, the inventory card sensor 570*a*, 570*b*, 670 may optically detect an identifier, or may employ RF, magnetic, inductance or other properties to detect the identity of the playing card.

At 1616, the playing card handing system 120*a*, 120*b* determines whether the inventory process is complete. For example, the playing card handing system 120*a*, 120*b* may determine whether every playing card receiving compartment 510*a*-510*c*, 512*a*-512*c*; 612*a*-612*c* of the particular intermediary playing card receiver 510, 512, 612 has been inspected. The playing card handing system 120*a*, 120*b* may rely on the compartment identifier 574*a*, 574*b* and/or on information from a positional or rotational encoder.

At 1618, the playing card handing system 120*a*, 120*b* transfers playing cards from intermediary playing card receiver to playing card output receiver in a random order, per normal operation as described above. The method 1600 terminates at 1620 or may repeat as an endless loop, thread or process.

Figure 17:
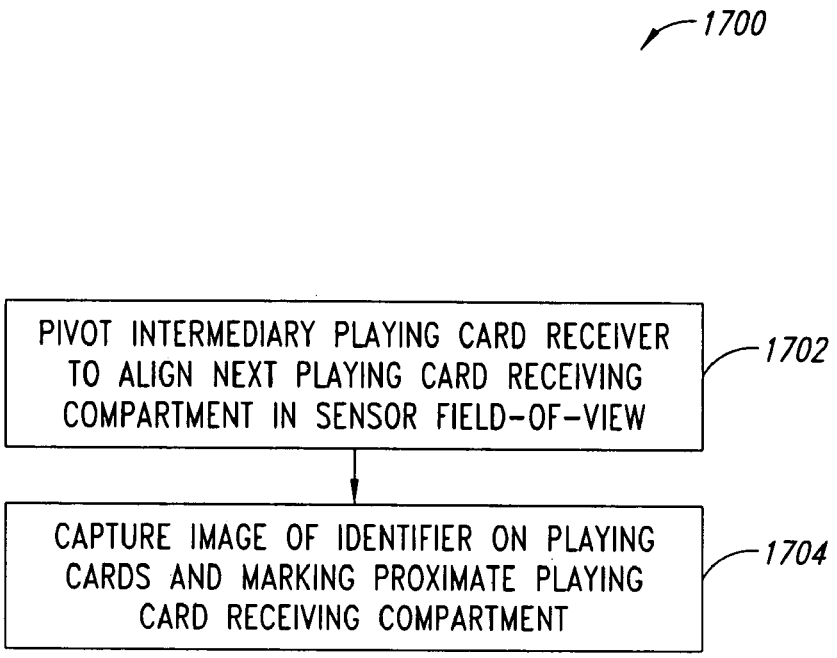
FIG. 17 is a flow diagram showing method of performing some of acts of the method of FIG. 16, according to one illustrated embodiment.

FIG. 17 shows method 1700 of performing some of the acts of the method 1600 (FIG. 16), according to one illustrated embodiment.

At 1702, the playing card handing system 120*a*, 120*b* pivots the intermediary playing card receiver 510, 512, 612 about an axis to align a next playing card receiving compartment 510*a*-510*c*, 512*a*-512*c*; 612*a*-612*c* with a field-of-view of the inventory card sensor. At 1704, the playing card handing system 120*a*, 120*b* captures an image of an identifier on the playing card and, optionally of a marking proximate the playing card receiving compartment 510*a*-510*c*, 512*a*-512*c*; 612*a*-612*c*.

Summary of Various Embodiments

It is appreciated that concurrent provision of randomized playing cards 518, 618, 718, random generation of virtual playing cards values, and/or transportation of collected playing cards 515, 615 or playing card media 704 to through the playing card handling system 120 allows a series of card games to progress in an uninterrupted, or nearly uninterrupted, manner. That is, when the set of playing cards being dealt by hand or from the card shoe 118 is exhausted or nearly exhausted, one or more randomized playing cards 518, 618, 718 are readily available so that game play may continue.

The playing card handling system 120 may advantageously permit a payout or house odds and/or house advantage or theoretical hold to be set for individual participants 110, 114 at the gaming table 102.

The above description of illustrated embodiments, including what is described in the Abstract, is not intended to be exhaustive or to limit the claims to the precise embodiments disclosed. Although specific embodiments of and examples are described herein for illustrative purposes, various equivalent modifications can be made without departing from the spirit and scope of the teachings, as will be recognized by those skilled in the relevant art. The teachings provided herein can be applied to other playing card distributing systems, not necessarily the exemplary playing card handling systems generally described above.

For example, in some embodiments, the playing cards used are standard playing cards from one or more standard decks of fifty-two (52) playing cards. The standard playing cards have a uniform back and the faces each bear a respective combination of a first primary symbol and a second primary symbol. The first primary symbol is selected from a standard set of playing card rank symbols comprising: 2, 3, 4, 5, 6, 7, 8, 9, 10, J, Q, K, and A; and the second primary symbol is selected from a standard set of playing card suit symbols comprising: ♥, ♣, ♦, and ♠. One or more of the primary symbols may identify a value of the playing card under the rules of a specific card game. For example, in blackjack or twenty-one the ranks 2-10 are worth 2-10 points respectively, the ranks J-K are each worth 10 points, and the rank A is worth 10 or 1 point at the player's option. In other embodiments, the playing cards may have other symbols, graphics, backings, etc., and may even be modified within the playing card handling system 120 to add, enhance, or alter the value or significance of the playing card. In one embodiment, the playing cards are dual sided playing cards as described in U.S. patent application Ser. No. 10/902,436, which published on Jun. 2, 2005.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that certain mechanisms of taught herein are capable of being distributed as a program product in a variety of forms. and that an illustrative embodimentall dless of the e of sional bearing media used to actually carry out the distribution. Examples of signal bearing media include, but are not limited to, the following: recordable type media such as floppy disks, hard disk drives. CD ROMs, digital tape, and computer memory; and transmission type media such as digital and analog communication links using TDM or IP based communication links (e.g., packet links).

The various embodiments described above can be combined to provide further embodiments. All of the following U.S. Pat. Nos. and U.S patent application Ser. Nos.: 60/791,549, filed Apr. 12, 2006; 60/791,554, filed Apr. 12, 2006; 60/791,398, filed Apr. 12, 2006; 60/791,513, filed Apr. 12, 2006; and 60/808,164 filed May 23, 2006; and U.S. nonprovisional patent application Ser. No. 09/474,858, filed Dec. 30, 1999, and issued as U.S. Pat. No. 6,460,848on Oct. 8, 2002; 09/849,456, filed May 4, 2001, and issued as U.S. Pat No. 6,652,379 on Nov. 25, 2003; Ser. No. 09/790,480, filed Feb. 21, 2001, and issued as U.S. Pat. No. 6,685,568 on Feb. 3, 2004; Ser. No. 10/017,276, filed Dec. 13, 2001; Ser. No. 10/885,875, filed Jul. 7, 2004; Ser. No. 10/902,436, filed Jul. 29, 2004; Ser. No. 10/981,132, filed Nov. 3, 2004; Ser. No. 10/934,785, filed Sep. 2, 2004; and Ser. No. 10/823,051, filed Apr. 13, 2004, are incorporated herein by reference, in their entirety.

From the foregoing it will be appreciated that, although specific embodiments have been described herein for purposes of illustration, various modifications may be made without deviating from the spirit and scope of the teachings. Accordingly, the claims are not limited by the disclosed embodiments.

I claim:

1. A playing card handling system, comprising:

a playing card input receiver;

a playing card output receiver;

at least one playing card transport path extending between the playing card input receiver and the playing card output receiver;

an intermediary playing card receiver disposed between the playing card input receiver and the playing card output receiver in the at least one playing card transport path, the intermediary playing card receiver comprising a plurality of playing card receiving compartments, physically coupled for movement together;

an input optical sensor having a field-of-view encompassing a portion of the at least one playing card transport path upstream of the intermediary playing card receiver, the input optical sensor operable to capture identifying information from playing cards at a position upstream of the intermediary playing card receiver to assist in assigning playing cards to the plurality of playing card receiving compartments of the intermediary playing card receiver;

an inventory optical sensor having a field-of-view that encompasses a portion of the intermediary playing card receiver, and is operable to capture identifying information from playing cards received in the playing card receiving compartments of the intermediary playing card receiver to confirm the presence and identity of the playing cards assigned to the plurality of playing card receiving compartments of the intermediary playing card receiver; and a control subsystem configured to control a transfer of a plurality of playing cards from the input playing card receiver to the intermediary playing card receiver.

2. The playing card handling system of claim 1, further comprising:

a complementary intermediary playing card receiver disposed between the playing card input receiver and the playing card output receiver in the at least one playing card transport path, the complementary intermediary playing card receiver comprising a plurality of playin card receiving compartments movement together, and wherein the control subsystem is configured to allocate the plurality of playing cards between the intermediary playing card receiver and the complementary intermediary playing card receiver based on an order in which the playing cards will be arranged at the playing card output receiver.

3. The playing card handling system of claim 1, further comprising:

a drive system coupled to the intermediary playing card receiver and operable to pivot the intermediary playing card receiver about an axis.

4. The playing card handling system of claim 3 wherein the inventory optical sensor sequentially captures images of playing cards in respective ones of the playing card receiving compartments as the intermediary playing card receiver is pivotally stepped about the axis.

5. The playing card handling system of claim 1 wherein the control subsystem performs an inventory of the intermediary playing card receiver by sequentially moving the intermediary playing card receiver with respect to the input optical sensor and capturing an image of playing cards in respective ones of the playing card receiving compartments at each of at least some of a plurality of respective positions of the intermediary playing card receiver.

6. The playing card handling system of claim 1, further comprising:

a number of markings proximate each of at least some of the playing card receiving compartments of the intermediary playing card receiver, the markings indicative of a relative position of a most proximate one of the playing card receiving compartment with respect to other of the playing card receiving compartments of the intermediary playing card receiver.

7. The playing card handling system of claim 1, further comprising:

a complementary intermediary playing card receiver disposed between the playing card input receiver and the playing card output receiver in the at least one playing card transport path, the complementary intermediary playing card receiver comprising a plurality of playing card receiving compartments physically coupled for movement together, and wherein the intermediary playing card receiver and the complementary intermediary playing card receiver are further configured to have one of the intermediary card receiver and the complementary intermediary playing card receiver receive playing cards from the playing card input receiver and to have the other one of the intermediary card receiver and the complementary intermediary playing card receiver concurrently provide playing cards to the playing card output receiver.

8. A playing card handling system, comprising:

a playing card input receiver;

a playing card output receiver;

at least one playing card transport path extending between the playing card input receiver and the playing card output receiver;

a first intermediary playing card receiver disposed between the playing card input receiver and the playing card output receiver in the at least one playing card transport path, the first intermediary playing card receiver comprising a plurality of playing card receiving compartments physically coupled for movement together;

a second intermediary playing card receiver disposed between the playing card input receiver and the playing card output receiver in the at least one playing card transport path, the second intermediary playing card receiver comprising a plurality of playing card receiving compartments physically coupled for movement together;

an input optical sensor having a field-of-view encompassing a portion of the at least one playing card transport path upstream of the first and the second intermediary playing card receivers, the input optical sensor operable to capture identifying information from playing cards at a position upstream of the first and the second intermediary playing card receivers to assist in assigning playing cards to the plurality of playing card receiving compartments of the first and the second intermediary playing card receivers;

a first inventory optical sensor having a field-of-view that encompasses a portion of the first intermediary playing card receiver, and is operable to capture identifying information from playing cards received in the playing card receiving compartments of the first intermediary playing card receiver to confirm the presence and identity of the playing cards assigned to the plurality of playing card receiving compartments of the first intermediary playing card receiver; and a second inventory optical sensor having a field-of-view that encompasses a portion of the second intermediary playing card receiver, and is operable to capture identifying information from playing cards received in the playing card receiving compartments of the second intermediary playing card receiver to confirm the presence and identity of the playing cards assigned to the plurality off playing card receiving compartments of the second intermediary playing card receiver.

* * * * *